US009411319B1

(12) United States Patent
Matsui

(10) Patent No.: US 9,411,319 B1
(45) Date of Patent: Aug. 9, 2016

(54) ELECTRONIC APPARATUS

(71) Applicant: SEIKO EPSON CORPORATION, Tokyo (JP)

(72) Inventor: Tsuyoshi Matsui, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/018,921

(22) Filed: Feb. 9, 2016

(30) Foreign Application Priority Data

Feb. 10, 2015 (JP) ..... 2015-023800

(51) Int. Cl.

| | |
|---|---|
| ***G04G 9/02*** | (2006.01) |
| ***G04G 9/06*** | (2006.01) |
| ***G09G 3/34*** | (2006.01) |
| ***G04G 9/00*** | (2006.01) |

(52) U.S. Cl.
CPC ..... *G04G 9/02* (2013.01); *G04G 9/0023* (2013.01); *G04G 9/0082* (2013.01); *G04G 9/06* (2013.01); *G09G 3/344* (2013.01)

(58) Field of Classification Search
CPC ..... G04G 9/002; G04G 9/0047; G04G 9/02; G04G 9/0082; G04G 9/0639; G04G 9/12; G09G 3/34; G09G 3/344
See application file for complete search history.

(56) References Cited

U.S. PATENT DOCUMENTS

| | | | | |
|---|---|---|---|---|
| 6,714,486 | B2 * | 3/2004 | Biggs | G04G 9/00 368/10 |
| 7,843,769 | B2 * | 11/2010 | Ishida | G04G 9/00 368/239 |
| 8,237,653 | B2 | 8/2012 | Maeda et al. | |
| 8,319,726 | B2 * | 11/2012 | Kajino | G09G 3/344 345/107 |
| 2005/0185519 | A1 * | 8/2005 | Kent | G04G 9/02 368/239 |
| 2007/0183268 | A1 * | 8/2007 | Hong | G04G 9/12 368/82 |
| 2013/0142016 | A1 * | 6/2013 | Pozzo Di Borgo | G04C 3/002 368/82 |
| 2014/0071183 | A1 * | 3/2014 | Murayama | G09G 3/344 345/690 |
| 2014/0320468 | A1 * | 10/2014 | Murayama | G09G 3/344 345/206 |

FOREIGN PATENT DOCUMENTS

| | | |
|---|---|---|
| JP | 2004-028918 A | 1/2004 |
| JP | 2010-044397 A | 2/2010 |

* cited by examiner

*Primary Examiner* — Vit W Miska
(74) *Attorney, Agent, or Firm* — Global IP Counselors, LLP

(57) ABSTRACT

A display section that displays, based on an hour display table, an hour image data and a minute image data representing numerals corresponding to an hour and a minute measured by a time measurement section is provided, and the hour display table contains information that identifies a position different from a predetermined standard position as a display position of a numeral specified by at least one of the hour image data and the minute image data in accordance with the hour and minute even for the same hour or minute.

10 Claims, 21 Drawing Sheets

90

| MINUTE | IMAGE NAME | MACRO NAME | X COORDI-NATE | Y COORDI-NATE |
|---|---|---|---|---|
| 0 | MINUTE_A_00.bmp | EMAC_MINUTE_A_00 | X0 | Y0 |
| 1 | MINUTE_A_01.bmp | EMAC_MINUTE_A_01 | X1 | Y1 |
| 2 | MINUTE_A_02.bmp | EMAC_MINUTE_A_02 | X2 | Y2 |
| 3 | MINUTE_A_03.bmp | EMAC_MINUTE_A_03 | X3 | Y3 |
| 4 | MINUTE_A_04.bmp | EMAC_MINUTE_A_04 | X4 | Y4 |
| 5 | MINUTE_A_05.bmp | EMAC_MINUTE_A_05 | X5 | Y5 |
| 6 | MINUTE_A_06.bmp | EMAC_MINUTE_A_06 | X6 | Y6 |
| 7 | MINUTE_A_07.bmp | EMAC_MINUTE_A_07 | X7 | Y7 |
| 8 | MINUTE_A_08.bmp | EMAC_MINUTE_A_08 | X8 | Y8 |
| 9 | MINUTE_A_09.bmp | EMAC_MINUTE_A_09 | X9 | Y9 |
| 10 | MINUTE_A_10.bmp | EMAC_MINUTE_A_10 | X10 | Y10 |
| 11 | MINUTE_A_11.bmp | EMAC_MINUTE_A_11 | X11 | Y11 |
| 12 | MINUTE_A_12.bmp | EMAC_MINUTE_A_12 | X12 | Y12 |
| 13 | MINUTE_A_13.bmp | EMAC_MINUTE_A_13 | X13 | Y13 |
| 14 | MINUTE_A_14.bmp | EMAC_MINUTE_A_14 | X14 | Y14 |
| 15 | MINUTE_A_15.bmp | EMAC_MINUTE_A_15 | X15 | Y15 |
| 16 | MINUTE_A_16.bmp | EMAC_MINUTE_A_16 | X16 | Y16 |
| 17 | MINUTE_A_17.bmp | EMAC_MINUTE_A_17 | X17 | Y17 |
| 18 | MINUTE_A_18.bmp | EMAC_MINUTE_A_18 | X18 | Y18 |
| 19 | MINUTE_A_19.bmp | EMAC_MINUTE_A_19 | X19 | Y19 |
| 20 | MINUTE_A_20.bmp | EMAC_MINUTE_A_20 | X20 | Y20 |
| 21 | MINUTE_A_21.bmp | EMAC_MINUTE_A_21 | X21 | Y21 |
| 22 | MINUTE_A_22.bmp | EMAC_MINUTE_A_22 | X22 | Y22 |
| 23 | MINUTE_A_23.bmp | EMAC_MINUTE_A_23 | X23 | Y23 |
| 24 | MINUTE_A_24.bmp | EMAC_MINUTE_A_24 | X24 | Y24 |
| 25 | MINUTE_A_25.bmp | EMAC_MINUTE_A_25 | X25 | Y25 |
| 26 | MINUTE_A_26.bmp | EMAC_MINUTE_A_26 | X26 | Y26 |
| 27 | MINUTE_A_27.bmp | EMAC_MINUTE_A_27 | X27 | Y27 |
| 28 | MINUTE_A_28.bmp | EMAC_MINUTE_A_28 | X28 | Y28 |
| 29 | MINUTE_A_29.bmp | EMAC_MINUTE_A_29 | X29 | Y29 |
| 30 | MINUTE_A_30.bmp | EMAC_MINUTE_A_30 | X30 | Y30 |
| 31 | MINUTE_A_31.bmp | EMAC_MINUTE_A_31 | X31 | Y31 |
| 32 | MINUTE_A_32.bmp | EMAC_MINUTE_A_32 | X32 | Y32 |
| 33 | MINUTE_A_33.bmp | EMAC_MINUTE_A_33 | X33 | Y33 |
| 34 | MINUTE_A_34.bmp | EMAC_MINUTE_A_34 | X34 | Y34 |
| 35 | MINUTE_A_35.bmp | EMAC_MINUTE_A_35 | X35 | Y35 |
| 36 | MINUTE_A_36.bmp | EMAC_MINUTE_A_36 | X36 | Y36 |
| 37 | MINUTE_A_37.bmp | EMAC_MINUTE_A_37 | X37 | Y37 |
| 38 | MINUTE_A_38.bmp | EMAC_MINUTE_A_38 | X38 | Y38 |
| 39 | MINUTE_A_39.bmp | EMAC_MINUTE_A_39 | X39 | Y39 |
| 40 | MINUTE_A_40.bmp | EMAC_MINUTE_A_40 | X40 | Y40 |
| 41 | MINUTE_A_41.bmp | EMAC_MINUTE_A_41 | X41 | Y41 |
| 42 | MINUTE_A_42.bmp | EMAC_MINUTE_A_42 | X42 | Y42 |
| 43 | MINUTE_A_43.bmp | EMAC_MINUTE_A_43 | X43 | Y43 |
| 44 | MINUTE_A_44.bmp | EMAC_MINUTE_A_44 | X44 | Y44 |
| 45 | MINUTE_A_45.bmp | EMAC_MINUTE_A_45 | X45 | Y45 |
| 46 | MINUTE_A_46.bmp | EMAC_MINUTE_A_46 | X46 | Y46 |
| 47 | MINUTE_A_47.bmp | EMAC_MINUTE_A_47 | X47 | Y47 |
| 48 | MINUTE_A_48.bmp | EMAC_MINUTE_A_48 | X48 | Y48 |
| 49 | MINUTE_A_49.bmp | EMAC_MINUTE_A_49 | X49 | Y49 |
| 50 | MINUTE_A_50.bmp | EMAC_MINUTE_A_50 | X50 | Y50 |
| 51 | MINUTE_A_51.bmp | EMAC_MINUTE_A_51 | X51 | Y51 |
| 52 | MINUTE_A_52.bmp | EMAC_MINUTE_A_52 | X52 | Y52 |
| 53 | MINUTE_A_53.bmp | EMAC_MINUTE_A_53 | X53 | Y53 |
| 54 | MINUTE_A_54.bmp | EMAC_MINUTE_A_54 | X54 | Y54 |
| 55 | MINUTE_A_55.bmp | EMAC_MINUTE_A_55 | X55 | Y55 |
| 56 | MINUTE_A_56.bmp | EMAC_MINUTE_A_56 | X56 | Y56 |
| 57 | MINUTE_A_57.bmp | EMAC_MINUTE_A_57 | X57 | Y57 |
| 58 | MINUTE_A_58.bmp | EMAC_MINUTE_A_58 | X58 | Y58 |
| 59 | MINUTE_A_59.bmp | EMAC_MINUTE_A_59 | X59 | Y59 |

FIG. 10

91

| | | HOUR | | | | | | | | | | | | | |
|---|---|---|---|---|---|---|---|---|---|---|---|---|---|---|---|
| | | 0 | 1 | 2 | 3 | ··· | 8 | 9 | 10 | 11 | ··· | 20 | 21 | 22 | 23 |
| MINUTE | 00 | 14 | 15 | 16 | 17 | ··· | 22 | 23 | 24 | 25 | ··· | 35 | 36 | 37 | 38 |
| | 01 | 14 | 15 | 16 | 17 | ··· | 22 | 23 | 24 | 25 | ··· | 35 | 36 | 37 | 38 |
| | 02 | 14 | 15 | 16 | 17 | ··· | 22 | 23 | 24 | 25 | ··· | 35 | 36 | 37 | 38 |
| | 03 | 14 | 15 | 16 | 17 | ··· | 22 | 23 | 24 | 25 | ··· | 35 | 36 | 37 | 38 |
| | 04 | 14 | 15 | 16 | 17 | ··· | 22 | 23 | 24 | 25 | ··· | 35 | 36 | 37 | 38 |
| | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| | 29 | 14 | 15 | 16 | 17 | ··· | 22 | 23 | 24 | 25 | ··· | 35 | 36 | 37 | 38 |
| | 30 | 14 | 15 | 16 | 17 | ··· | 13 | 23 | 24 | 25 | ··· | 26 | 36 | 37 | 38 |
| | 31 | 14 | 15 | 16 | 17 | ··· | 13 | 23 | 24 | 25 | ··· | 26 | 36 | 37 | 38 |
| | 32 | 14 | 15 | 16 | 17 | ··· | 13 | 23 | 24 | 25 | ··· | 26 | 36 | 37 | 38 |
| | 33 | 14 | 15 | 16 | 17 | ··· | 13 | 23 | 24 | 25 | ··· | 26 | 36 | 37 | 38 |
| | 34 | 14 | 15 | 16 | 17 | ··· | 13 | 23 | 24 | 25 | ··· | 26 | 36 | 37 | 38 |
| | 35 | 14 | 15 | 16 | 17 | ··· | 13 | 23 | 24 | 25 | ··· | 26 | 36 | 37 | 38 |
| | 36 | 14 | 15 | 16 | 17 | ··· | 13 | 23 | 24 | 25 | ··· | 26 | 36 | 37 | 38 |
| | 37 | 14 | 15 | 16 | 17 | ··· | 13 | 23 | 24 | 25 | ··· | 26 | 36 | 37 | 38 |
| | 38 | 14 | 15 | 16 | 17 | ··· | 13 | 23 | 24 | 25 | ··· | 26 | 36 | 37 | 38 |
| | 39 | 14 | 15 | 16 | 17 | ··· | 13 | 23 | 24 | 25 | ··· | 26 | 36 | 37 | 38 |
| | 40 | 14 | 15 | 16 | 17 | ··· | 22 | 23 | 24 | 25 | ··· | 35 | 36 | 37 | 38 |
| | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| | 56 | 14 | 15 | 16 | 17 | ··· | 22 | 23 | 24 | 25 | ··· | 35 | 36 | 37 | 38 |
| | 57 | 14 | 15 | 16 | 17 | ··· | 22 | 23 | 24 | 25 | ··· | 35 | 36 | 37 | 38 |
| | 58 | 14 | 15 | 16 | 17 | ··· | 22 | 23 | 24 | 25 | ··· | 35 | 36 | 37 | 38 |
| | 59 | 14 | 15 | 16 | 17 | ··· | 22 | 23 | 24 | 25 | ··· | 35 | 36 | 37 | 38 |

FIG. 11

92

| ADJUSTMENT NUMBER | MACRO NAME | IMAGE NAME | X COORDINATE | Y COORDINATE | CONTENT OF MACRO |
|---|---|---|---|---|---|
| 13 | EMAC_APPEND_A013 | HOUR_B_13.bmp | X13 | Y13 | SPECIAL FONT OF 8 AM (CHARACTERS) |
| 14 | EMAC_APPEND_A014 | HOUR_B_00.bmp | X00 | Y00 | OVERWRITE CURRENT TIME WITH 12 AM (CHARACTERS) |
| 15 | EMAC_APPEND_A015 | HOUR_B_01.bmp | X01 | Y01 | OVERWRITE CURRENT TIME WITH 1 AM (CHARACTERS) |
| 16 | EMAC_APPEND_A016 | HOUR_B_02.bmp | X02 | Y02 | OVERWRITE CURRENT TIME WITH 2 AM (CHARACTERS) |
| 17 | EMAC_APPEND_A017 | HOUR_B_03.bmp | X03 | Y03 | OVERWRITE CURRENT TIME WITH 3 AM (CHARACTERS) |
| 18 | EMAC_APPEND_A018 | HOUR_B_04.bmp | X04 | Y04 | OVERWRITE CURRENT TIME WITH 4 AM (CHARACTERS) |
| 19 | EMAC_APPEND_A019 | HOUR_B_05.bmp | X05 | Y05 | OVERWRITE CURRENT TIME WITH 5 AM (CHARACTERS) |
| 20 | EMAC_APPEND_A020 | HOUR_B_06.bmp | X06 | Y06 | OVERWRITE CURRENT TIME WITH 6 AM (CHARACTERS) |
| 21 | EMAC_APPEND_A021 | HOUR_B_07.bmp | X07 | Y07 | OVERWRITE CURRENT TIME WITH 7 AM (CHARACTERS) |
| 22 | EMAC_APPEND_A022 | HOUR_B_08.bmp | X08 | Y08 | OVERWRITE CURRENT TIME WITH 8 AM (CHARACTERS) |
| 23 | EMAC_APPEND_A023 | HOUR_B_09.bmp | X09 | Y09 | OVERWRITE CURRENT TIME WITH 9 AM (CHARACTERS) |
| 24 | EMAC_APPEND_A024 | HOUR_B_10.bmp | X10 | Y10 | OVERWRITE CURRENT TIME WITH 10 AM (CHARACTERS) |
| 25 | EMAC_APPEND_A025 | HOUR_B_11.bmp | X11 | Y11 | OVERWRITE CURRENT TIME WITH 11 AM (CHARACTERS) |
| 26 | EMAC_APPEND_A026 | HOUR_B_13.bmp | X13 | Y13 | SPECIAL FONT OF 8 PM (CHARACTERS) |
| 27 | EMAC_APPEND_A027 | HOUR_B_00.bmp | X00 | Y00 | OVERWRITE CURRENT TIME WITH 12 PM (CHARACTERS) |
| 28 | EMAC_APPEND_A028 | HOUR_B_01.bmp | X01 | Y01 | OVERWRITE CURRENT TIME WITH 1 PM (CHARACTERS) |
| 29 | EMAC_APPEND_A029 | HOUR_B_02.bmp | X02 | Y02 | OVERWRITE CURRENT TIME WITH 2 PM (CHARACTERS) |
| 30 | EMAC_APPEND_A030 | HOUR_B_03.bmp | X03 | Y03 | OVERWRITE CURRENT TIME WITH 3 PM (CHARACTERS) |
| 31 | EMAC_APPEND_A031 | HOUR_B_04.bmp | X04 | Y04 | OVERWRITE CURRENT TIME WITH 4 PM (CHARACTERS) |
| 32 | EMAC_APPEND_A032 | HOUR_B_05.bmp | X05 | Y05 | OVERWRITE CURRENT TIME WITH 5 PM (CHARACTERS) |
| 33 | EMAC_APPEND_A033 | HOUR_B_06.bmp | X06 | Y06 | OVERWRITE CURRENT TIME WITH 6 PM (CHARACTERS) |
| 34 | EMAC_APPEND_A034 | HOUR_B_07.bmp | X07 | Y07 | OVERWRITE CURRENT TIME WITH 7 PM (CHARACTERS) |
| 35 | EMAC_APPEND_A035 | HOUR_B_08.bmp | X08 | Y08 | OVERWRITE CURRENT TIME WITH 8 PM (CHARACTERS) |
| 36 | EMAC_APPEND_A036 | HOUR_B_09.bmp | X09 | Y09 | OVERWRITE CURRENT TIME WITH 9 PM (CHARACTERS) |
| 37 | EMAC_APPEND_A037 | HOUR_B_10.bmp | X10 | Y10 | OVERWRITE CURRENT TIME WITH 10 PM (CHARACTERS) |
| 38 | EMAC_APPEND_A038 | HOUR_B_11.bmp | X11 | Y11 | OVERWRITE CURRENT TIME WITH 11 PM (CHARACTERS) |

FIG. 12

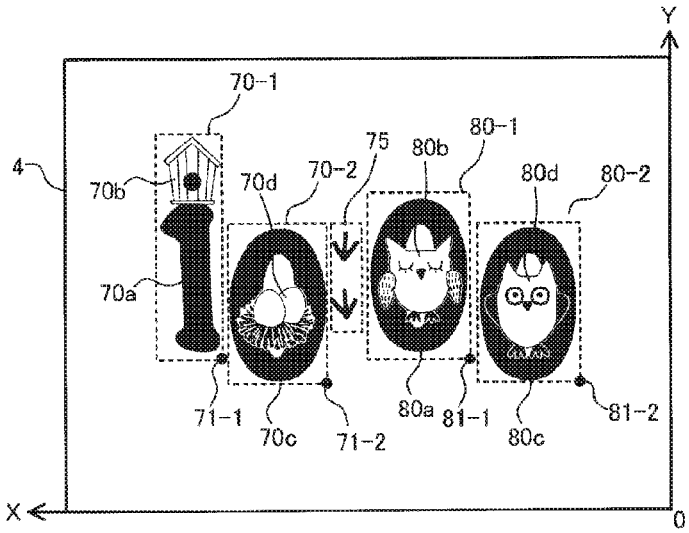

FIG. 22

91

| HOUR | | IMAGE NAME | MACRO NAME | X COORDINATE | Y COORDINATE |
|---|---|---|---|---|---|
| 0 | – | – | – | – | – |
| | 0 | HOUR_C_000L.bmp | EMAC_HOUR_C_A00L | X000 | Y000 |
| 1 | – | – | – | – | – |
| | 1 | HOUR_C_001L.bmp | EMAC_HOUR_C_A01L | X010 | Y010 |
| 2 | – | – | – | – | – |
| | 2 | HOUR_C_002L.bmp | EMAC_HOUR_C_A02L | X020 | Y020 |
| ⋮ | ⋮ | ⋮ | ⋮ | ⋮ | ⋮ |
| 10 | 1 | HOUR_C_101H.bmp | EMAC_HOUR_C_A10H | X101 | Y101 |
| | 0 | HOUR_C_000L.bmp | EMAC_HOUR_C_A00L | X000 | Y000 |
| 11 | 1 | HOUR_C_101H.bmp | EMAC_HOUR_C_A11H | X111 | Y111 |
| | 1 | HOUR_C_001L.bmp | EMAC_HOUR_C_A01L | X010 | Y010 |
| 12 | 1 | HOUR_C_101H.bmp | EMAC_HOUR_C_A12H | X121 | Y121 |
| | 2 | HOUR_C_002L.bmp | EMAC_HOUR_C_A02L | X020 | Y020 |
| ⋮ | ⋮ | ⋮ | ⋮ | ⋮ | ⋮ |
| 22 | 2 | HOUR_C_202H.bmp | EMAC_HOUR_C_A22H | X221 | Y221 |
| | 2 | HOUR_C_002L.bmp | EMAC_HOUR_C_A02L | X020 | Y020 |
| 23 | 2 | HOUR_C_202H.bmp | EMAC_HOUR_C_A23H | X231 | Y231 |
| | 3 | HOUR_C_003L.bmp | EMAC_HOUR_C_A03L | X020 | Y020 |

FIG. 23

90

| MINUTE | | IMAGE NAME | MACRO NAME | X COORDI-NATE | Y COORDI-NATE |
|---|---|---|---|---|---|
| 00 | 0 | MINUTE_C_000H.bmp | EMAC_MINUTE_C_A00H | X002 | Y002 |
| | 0 | MINUTE_C_000L.bmp | EMAC_MINUTE_C_A00L | X003 | Y003 |
| 01 | 0 | MINUTE_C_000H.bmp | EMAC_MINUTE_C_A00H | X002 | Y002 |
| | 1 | MINUTE_C_001L.bmp | EMAC_MINUTE_C_A01L | X013 | Y013 |
| 02 | 0 | MINUTE_C_000H.bmp | EMAC_MINUTE_C_A00H | X002 | Y002 |
| | 2 | MINUTE_C_002L.bmp | EMAC_MINUTE_C_A02L | X023 | Y023 |
| ⋮ | ⋮ | ⋮ | ⋮ | ⋮ | ⋮ |
| 10 | 1 | MINUTE_C_101H.bmp | EMAC_MINUTE_C_A10H | X102 | Y102 |
| | 0 | MINUTE_C_000L.bmp | EMAC_MINUTE_C_A00L | X003 | Y003 |
| 11 | 1 | MINUTE_C_101H.bmp | EMAC_MINUTE_C_A10H | X102 | Y102 |
| | 1 | MINUTE_C_001L.bmp | EMAC_MINUTE_C_A01L | X013 | Y013 |
| 12 | 1 | MINUTE_C_101H.bmp | EMAC_MINUTE_C_A10H | X102 | Y102 |
| | 2 | MINUTE_C_002L.bmp | EMAC_MINUTE_C_A02L | X023 | Y023 |
| ⋮ | ⋮ | ⋮ | ⋮ | ⋮ | ⋮ |
| 22 | 2 | MINUTE_C_202H.bmp | EMAC_MINUTE_C_A20H | X202 | Y202 |
| | 2 | MINUTE_C_002L.bmp | EMAC_MINUTE_C_A02L | X023 | Y023 |
| 23 | 2 | MINUTE_C_202H.bmp | EMAC_MINUTE_C_A20H | X202 | Y202 |
| | 3 | MINUTE_C_003L.bmp | EMAC_MINUTE_C_A03L | X033 | Y033 |
| 24 | 2 | MINUTE_C_202H.bmp | EMAC_MINUTE_C_A20H | X202 | Y202 |
| | 4 | MINUTE_C_004L.bmp | EMAC_MINUTE_C_A04L | X043 | Y043 |
| ⋮ | ⋮ | ⋮ | ⋮ | ⋮ | ⋮ |
| 57 | 5 | MINUTE_C_505H.bmp | EMAC_MINUTE_C_A50H | X502 | Y502 |
| | 7 | MINUTE_C_007L.bmp | EMAC_MINUTE_C_A07L | X073 | Y073 |
| 58 | 5 | MINUTE_C_505H.bmp | EMAC_MINUTE_C_A50H | X502 | Y502 |
| | 8 | MINUTE_C_008L.bmp | EMAC_MINUTE_C_A08L | X083 | Y083 |
| 59 | 5 | MINUTE_C_505H.bmp | EMAC_MINUTE_C_A50H | X502 | Y502 |
| | 9 | MINUTE_C_009L.bmp | EMAC_MINUTE_C_A09L | X093 | Y093 |

FIG. 24

ELECTRONIC APPARATUS

BACKGROUND

1. Technical Field

The present invention relates to an electronic apparatus including a time measurement section that measures hours and minutes and a display section that displays the hour and minute.

2. Related Art

At present, since the accuracy of time measured by a timepiece has been drastically improved, a timepiece that simply displays accurate time has become less attractive than ever, and a fashionable timepiece and a playfully designed timepiece increasingly tend to be required. As a solution to realization of such a timepiece, it is conceivable to allow a timepiece to display not only accurate time but also a fashionable content or a playfully designed content. For example, there is a proposed electronic timepiece that incorporates a liquid crystal display device that displays geometric images, animation images, or other images or has an aesthetically joyful, fashionable color-changing function (JP-A-2004-28918, for example).

The electronic timepiece described in JP-A-2004-28918, however, uses the same font both in image data representing the hour digits and image data representing the minute digits, and it cannot therefore be said that diversity in time display is provided. Further, in the electronic timepiece described in JP-A-2004-28918, the image data representing hours and the image data representing minutes are handled together and the display position thereof can therefore be changed together. However, for example, the display position of the hour digits and the display position of the minute digits are not separately changed to other positions. It is therefore conceivable that use of a special font makes displayed time illegible.

SUMMARY

An advantage of some aspects of the invention is to provide an electronic apparatus capable of not only simply displaying hours and minutes but also providing diversity in hour and minute display and further capable of legible time display irrespective of a font used.

An electronic apparatus according to an aspect of the invention includes a time measurement section that measures time including an hour and a minute, an image storage section that stores a plurality of sets of hour image data representing numerals corresponding to hours and a plurality of sets of minute image data representing numerals corresponding to minutes, a display table representing information that identifies the hour image data and the minute image data used to display a predetermined hour and minute and information that identifies a display position of a numeral specified by at least one of the identified hour image data and minute image data, and a display section that displays, based on the display table, the hour image data and the minute image data representing numerals corresponding to the hour and minute measured by the time measurement section, and the display table contains information that identifies, when the hour and minute are a first hour and minute, a first position as the display position of the numeral specified by at least one of the hour image data and the minute image data and information that identifies, when the hour and minute are a second hour and minute that differ from the first hour and minute and have the same hour or minute as the first hour or minute, a second position different from the first position.

According to the aspect of the invention, the display table represents combinations of information that identifies hour image data and minute image data used to display a predetermined hour and minute and information that identifies the display position of a numeral specified by at least one of the hour image data and the minute image data. The display table contains information that identifies, when the hour and minute are a first hour and minute, a first position as the display position of the numeral specified by at least one of the hour image data and the minute image data and information that identifies, when the hour and minute are a second hour and minute that differ from the first hour and minute and have the same hour or minute as the first hour or minute, a second position different from the first position. Therefore, when hour image data and minute image data representing numerals corresponding to the hour and minute measured by the time measurement section are displayed in the display section, at least one of the hour image data and the minute image data is displayed in the second position different from the first position in accordance with the hour and minute even for the same hour or minute. As a result, legible hour and minute display is performed irrespective of a font used in the display.

In the aspect of the invention, the "electronic apparatus" is a concept including a wristwatch-type electronic timepiece, a wrist-worn sport apparatus, a wearable apparatus, and other apparatus.

An electronic apparatus according to another aspect of the invention includes a time measurement section that measures time including an hour and a minute, an image storage section that stores hour image data representing numerals corresponding to hours and minute image data representing numerals corresponding to minutes, a display table representing a combination of information that identifies the hour image data and the minute image data used to display a predetermined hour and minute and information that identifies display positions of the hour image data and the minute image data, and a display section that displays, based on the display table, the hour image data and the minute image data representing numerals corresponding to the hour and minute measured by the time measurement section. The image storage section stores first or second hour image data as hour image data representing a numeral corresponding to one of the hours, and the display table contains information that identifies the first hour image data as the hour image data when the hour is the one of the hours and the minute is a first minute and information that identifies the second hour image data as the hour image data when the hour is the one of the hours and the minute is a second minute different from the first minute.

According to the aspect of the invention, the display table represents combinations of information that identifies hour image data and minute image data used to display a predetermined hour and minute and information that identifies the display positions of the hour image data and the minute image data. The display table contains information that identifies first hour image data as the hour image data when the hour is one of the hours and the minute is a first minute and information that identifies second hour image data as the hour image data when the hour is the one of the hours and the minute is a second minute different from the first minute. Therefore, when hour image data and minute image data representing numerals corresponding to the hour and minute measured by the time measurement section are displayed in the display section, the second hour image data different from the first hour image data is displayed in accordance with the hour and minute even for the same hour or minute. As a result, legible hour and minute display is performed irrespective of a font used in the display. Further, diverse hour and minute display is performed.

In the aspect of the invention, the "electronic apparatus" is a concept including a wristwatch-type electronic timepiece, a wrist-worn sport apparatus, a wearable apparatus, and other apparatus.

In the electronic apparatus described above, it is preferable that each of the hour image data and the minute image data is image data that allows characters of a word representing a numeral to be drawn, and that under a definition that an x direction is a direction in which the characters are arranged and a y direction is a direction perpendicular to the x direction, the y-direction coordinate of the display position in a display area of the display section differs between the hour image data and the minute image data. In this case, although the hour image data and the minute image data are displayed in different positions in the y direction, at least one of the hour image data and the minute image data is displayed in a position different from a predetermined standard position in accordance with the hour and minute to be displayed, or image data different from predetermined standard image data is displayed in accordance with the hour and minute to be displayed, whereby legible time display is performed irrespective of the font used in the display, and diverse time display is performed.

An electronic apparatus according to still another aspect of the invention includes a time measurement section that measures time including an hour and a minute, an image storage section that stores a plurality of sets of hour image data representing numerals corresponding to hours and a plurality of sets of minute image data representing numerals corresponding to minutes, a display table representing information that identifies the hour image data and the minute image data used to display predetermined time and information that identifies display positions of the hour image data and the minute image data, and a display section that displays, based on the display table, the hour image data and the minute image data representing numerals corresponding to the hour and minute measured by the time measurement section, and the image storage section stores, as the minute image data, minute image data that allows an image representing a numeral corresponding to the minute and a non-numeral image to be drawn as a single image and further allows the non-numeral image for a first minute and the non-numeral image for a second minute to differ from each other.

According to the aspect of the invention, the display table represents combinations of information that identifies hour image data and minute image data used to display a predetermined hour and minute and information that identifies the display positions of the hour image data and the minute image data. Further, the minute image data includes minute image data that allows an image representing a numeral corresponding to the minute and a non-numeral image to be drawn as a single image and that allows the non-numeral image to be different by minute. Therefore, when hour image data and minute image data representing numerals corresponding to the hour and minute measured by the time measurement section are displayed in the display section, at a first minute and a second minute, different images are displayed as the non-numeral image, whereby diverse hour and minute displayed is performed.

In the aspect of the invention, the "electronic apparatus" is a concept including a wristwatch-type electronic timepiece, a wrist-worn sport apparatus, a wearable apparatus, and other apparatus.

In the electronic apparatus described above, it is preferable that the image storage section stores, as the hour image data, first hour image data that allows an image representing a numeral corresponding to the tens place of each of the hours and a non-numeral image to be drawn as a single image and further allows the non-numeral image to change when the numeral corresponding to the tens place changes and second hour image data that allows an image representing a numeral corresponding to the ones place of each of the hours and a non-numeral image to be drawn as a single image and further allows the non-numeral image to change when the numeral corresponding to the ones place changes and further stores, as the minute image data, first minute image data that allows an image representing a numeral corresponding to the tens place of each of the minutes and a non-numeral image to be drawn as a single image and further allows the non-numeral image to change when the numeral corresponding to the tens place changes and second minute image data that allows an image representing a numeral corresponding to the ones place of each of the minutes and a non-numeral image to be drawn as a single image and further allows the non-numeral image to change when the numeral corresponding to the ones place changes, and the display table includes combinations of information that identifies the first hour image data and the second hour image data as well as the first minute image data and the second minute image data used to display predetermined time and information that identifies display positions of the first hour image data and the second hour image data and display positions of the first minute image data and the second minute image data.

In this case, different images are displayed as the non-numeral image at each of the tens place and the ones place of each of the hours and at the tens place and the ones place of each of the minutes. Therefore, when hour image data and minute image data representing numerals corresponding to the hour and minute measured by the time measurement section are displayed in the display section, diverse hour and minute display is performed.

In the electronic apparatus described above, it is preferable that the image storage section stores, as the minute image data, minute image data that allows an image representing each of numerals from 0 to 59 corresponding to the minutes and a non-numeral image to be drawn as a single image and further allows the non-numeral image to vary. In this case, different images are displayed as the non-numeral image whenever the minute advances, whereby diverse hour and minute display is performed.

In the electronic apparatus described above, it is preferable that the image storage section stores, as the hour image data, hour image data that allows an image representing each of numerals from 1 to 12 corresponding to the hours to be drawn. In this case, legible hour and minute display is performed, while diverse hour and minute display is performed.

In the electronic apparatus described above, it is preferable that the image storage section stores, as the hour image data, hour image data that allows an image representing each of numerals from 0 to 23 corresponding to the hours to be drawn. In this case, legible hour and minute display is performed, while diverse hour and minute display is performed.

In the electronic apparatus described above, it is preferable that the image storage section stores, as the first hour image data, first hour image data that allows an image representing each of numerals from 1 to 2 corresponding to the tens place of the hours and a non-numeral image to be drawn as a single image and further allows the non-numeral image to change when the numeral corresponding to the tens place changes, further stores, as the second hour image data, second hour image data that allows an image representing each of numerals from 0 to 9 corresponding to the ones place of the hours and a non-numeral image to be drawn as a single image and further allows the non-numeral image to change when the numeral corresponding to the ones place changes, further stores, as the first minute image data, first minute image data that allows an image representing each of numerals from 0 to 5 corresponding to the tens place of the minutes and a non-numeral image to be drawn as a single image and further allows the non-numeral image to change when the numeral corresponding to the tens place changes, and further stores, as the second minute image data, second minute image data that allows an image representing each of numerals from 0 to 9 corresponding to the ones place of the minutes and a non-numeral image to be drawn as a single image and further allows the non-numeral image to change when the numeral corresponding to the ones place changes.

In this case, different images are displayed as the non-numeral image at each of the tens place and the ones place of each of the hours and at the tens place and the ones place of each of the minutes. Therefore, when hour image data and minute image data representing numerals corresponding to the hour and minute measured by the time measurement section are displayed in the display section, diverse hour and minute display is performed. Further, legible time and minute display is performed.

An electronic apparatus according to yet another aspect of the invention includes a time measurement section that measures time including an hour and a minute, an image storage section that stores a plurality of sets of hour image data representing numerals corresponding to hours and a plurality of sets of minute image data representing numerals corresponding to minutes, and a display section that displays the hour image data and the minute image data representing numerals corresponding to the hour and minute measured by the time measurement section, and the display section displays at least one of the hour image data and the minute image data in a first position when the time and minute are a first hour and minute, whereas displaying at least one of the hour image data and the minute image data in a second position different from the first position when the hour and minute are a second hour and minute that differ from the first hour and minute but have the same hour or minute of the first hour and minute.

According to the aspect of the invention, when hour image data and minute image data representing numerals corresponding to the hour and minute measured by the time measurement section are displayed in the display section, and when the hour and minute are a first hour and minute, at least one of the hour image data and the minute image data is displayed in a first position, whereas when the hour and minute are a second hour and minute that differ from the first hour and minute but have the same hour or minute of the first hour and minute, at least one of the hour image data and the minute image data is displayed in a second position different from the first position. As a result, legible hour and minute display is performed irrespective of the font used in the display. Further, diverse time display is performed.

In the aspect of the invention, the "electronic apparatus" is a concept including a wristwatch-type electronic timepiece, a wrist-worn sport apparatus, a wearable apparatus, and other apparatus.

An electronic apparatus according to still yet another aspect of the invention includes a time measurement section that measures time including an hour and a minute, an image storage section that stores a plurality of sets of hour image data representing numerals corresponding to hours and a plurality of sets of minute image data representing numerals corresponding to minutes, and a display section that displays the hour image data and the minute image data representing numerals corresponding to the hour and minute measured by the time measurement section. The image storage section stores first or second hour image data as hour image data representing numerals corresponding to a predetermined hour and minute, and the display section displays, at the predetermined hour and minute, the first hour image data when the minute is a first minute, whereas displaying the second hour image data when the minute is a second minute different from the first minute.

According to the aspect of the invention, when hour image data and minute image data representing numerals corresponding to the hour and minute measured by the time measurement section are displayed in the display section, at a predetermined hour and minute, the first hour image data is displayed when the minute is a first minute, whereas the second hour image data is displayed when the minute is a second minute different from the first minute. Diverse hour and minute display is therefore performed.

In the aspect of the invention, the "electronic apparatus" is a concept including a wristwatch-type electronic timepiece, a wrist-worn sport apparatus, a wearable apparatus, and other apparatus.

An electronic apparatus according to further another aspect of the invention includes a time measurement section that measures time including an hour and a minute, an image storage section that stores a plurality of sets of hour image data representing numerals corresponding to hours and a plurality of sets of minute image data representing numerals corresponding to minutes, and a display section that displays the hour image data and the minute image data representing numerals corresponding to the hour and minute measured by the time measurement section, and the image storage section stores, as the minute image data, minute image data that allows an image representing a numeral corresponding to the minute and a non-numeral image to be drawn as a single image and further allows the non-numeral image for a first minute and the non-numeral image for a second minute to differ from each other.

According to the aspect of the invention, when minute image data representing a numeral corresponding to the minute measured by the time measurement section is displayed in the display section, the minute image data is so displayed that an image representing a numeral corresponding to the minute and a non-numeral image are displayed as a single image and the non-numeral image for a first minute and the non-numeral image for a second minute differ from each other. Diverse hour and minute display is therefore performed.

In the aspect of the invention, the "electronic apparatus" is a concept including a wristwatch-type electronic timepiece, a wrist-worn sport apparatus, a wearable apparatus, and other apparatus.

BRIEF DESCRIPTION OF THE DRAWINGS

The invention will be described with reference to the accompanying drawings, wherein like numbers reference like elements.

FIG. 10 shows a minute display table.

FIG. 11 shows an hour display table.

FIG. 12 shows an hour display position adjustment table.

FIG. 22 shows an example of display in the display section according to a third embodiment of the invention.

FIG. 23 shows an hour display table in the third embodiment.

FIG. 24 shows a minute display table in the third embodiment.

DESCRIPTION OF EXEMPLARY EMBODIMENTS

Figure 1:
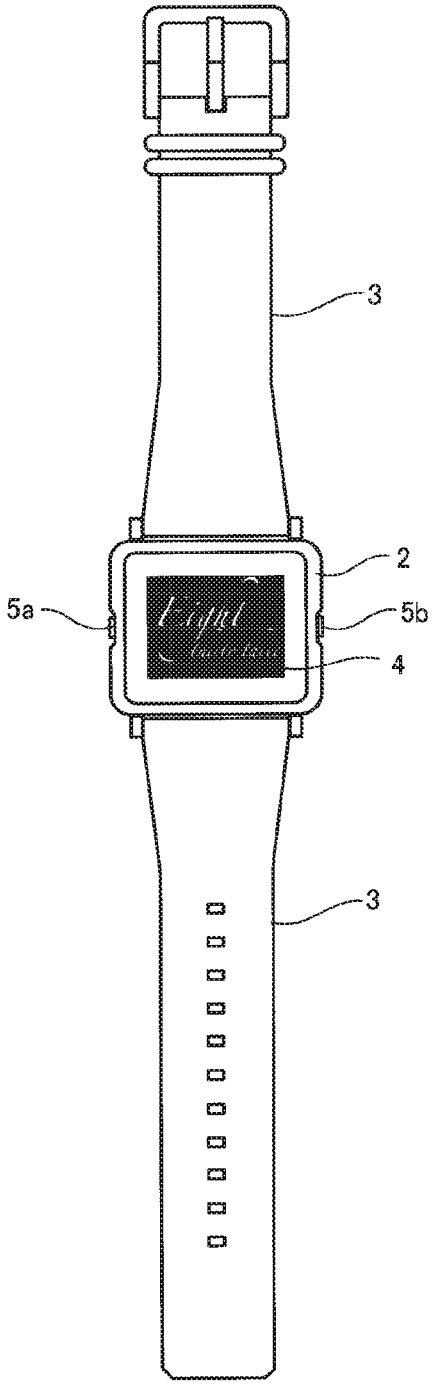
FIG. 1 is an exterior appearance view of an electronic timepiece according to a first embodiment of the invention.

Preferable embodiments of the invention will be described below in detail with reference to the accompanying drawings and the like. It is noted in the drawing that the dimension and scale of each portion differ from an actual dimension and scale thereof as appropriate. Further, each embodiment described below is a preferable specific example of the invention, and a variety of technically preferable restrictions are therefore imposed thereon. The scope of the invention is, however, not limited to the embodiments unless otherwise particularly stated in the following description that a limitation is imposed on the invention.

First Embodiment

A: Summary of Electronic Timepiece

A first embodiment of the invention will be described with reference to FIGS. 1 to 17. FIG. 1 is an exterior appearance view of an electronic timepiece 1 as an example of an electronic apparatus according to the present embodiment and a plan view of the electronic timepiece 1 viewed in a direction that is perpendicular to a display section and allows visual recognition of the display section (front side). The electronic timepiece 1 according to the present embodiment is a wristwatch and includes a timepiece case 2, a pair of bands 3, which are connected to the timepiece case 2, and other components, as shown in FIG. 1. The bands 3 may instead be straps or belts.

A display section 4, which is formed of an electrophoretic display (EPD) panel, is provided on the front side of the timepiece case 2, and an operation button A (5*a*) and an operation button B (5*b*) are provided on side surfaces of the timepiece case 2 (surfaces perpendicular to direction toward front side).

In response to operation of pressing the operation button A (5*a*) or the operation button B (5*b*) (input operation), the display section 4 displays a variety of images, for example, a variety of images including time information updated every minute or second, an image representing passage of time, and an image for time correction.

An electrophoretic display device including the display section 4 and a driver (not shown) that drives the display section 4 (only display section is shown) is provided in the timepiece case 2.

B: Configuration of Electrophoretic Display Device

Figure 2:
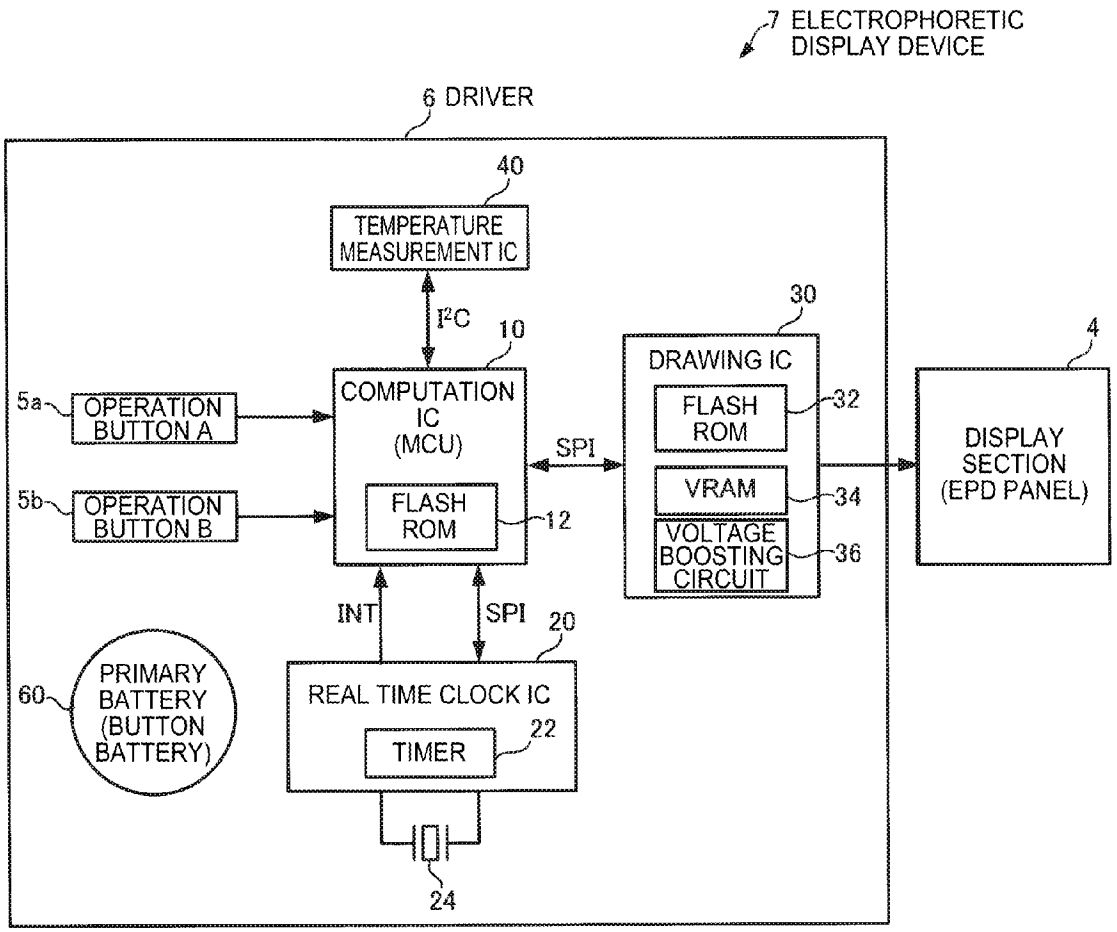
FIG. 2 is a functional block diagram of an electrophoretic display device according to the first embodiment.

FIG. 2 is a functional block diagram of the electrophoretic display device provided in the electronic timepiece 1 according to the present embodiment. An electrophoretic display device 7 provided in the electronic timepiece 1 according to the present embodiment includes the display section 4 (see FIG. 1) and a driver 6, and the driver 6 includes a computation IC (integrated circuit) 10, a real time clock (RTC) IC 20, a drawing IC 30, and a temperature measurement IC 40, as shown in FIG. 2. As will be described later, in the present embodiment, the ICs and the display section 4 are so configured that they consume a small amount of electric power, whereby the electrophoretic display device 7 keeps operating for several years only with a small-capacity primary battery 60, such as a button battery. The electrophoretic display device 7 may instead be so configured that it operates with a chargeable battery (secondary battery).

In the present embodiment, the computation IC 10 is achieved by use of a highly versatile microcomputer unit (MCU) having a rewritable flash ROM 12 built therein and operates in accordance with a program and data stored in the flash ROM 12. The function of the computation IC 10 can therefore be readily changed by operation of rewriting the program and data stored in the flash ROM 12. Further, the program and data can instead be rewritten in a state in which the computation IC 10 is built in a movement (driver of timepiece), whereby the program can be readily changed.

The computation IC 10 carries out the process of determining the type of an image to be displayed in the display section 4 and a mode according to which an image is displayed in the display section 4 in accordance with operation of pressing the operation button A (5*a*) and the operation button B (5*b*) (input operation). The mode determined by the computation IC 10 is, for example, a minute update mode in which an image containing displayed time updated every minute is displayed in the display section 4 and a time correction mode in which the time displayed in the display section 4 is advanced or turned back in accordance with operation of pressing the operation button A (5*a*) or the operation button B (5*b*) (input operation).

The computation IC 10, for example, carries out the process of acquiring time information, such as date and time, from the real time clock IC 20, which serves as a time measurement section, and determining a content to be displayed in the display section 4 in a time display mode and carries out the process of transmitting a time correction value according to operation of pressing the operation button A (5*a*) and the operation button B (5*b*) (input operation) to the real time clock IC 20 in the time correction mode.

The flash ROM 12 stores a table for specifying a macro instruction for deleting an image displayed in the display section 4 (image deletion macro instruction) and a macro instruction for drawing a new image in the display section 4 (new image drawing macro instruction). Each of the macro instructions is stored in a flash ROM 32 in the drawing IC 30. The computation IC 10 carries out the process of reading the address of a desired macro instruction from the table in the flash ROM 12 at predetermined timing and instructing the drawing IC 30 to execute the macro instruction.

The computation IC 10 further carries out the process of transferring image data from the drawing IC 30 to the display section 4 and the process of instructing the drawing IC 30 to drive the display section 4. The computation IC 10 further supplies the drawing IC 30 with a reference signal (4 kHz, for example) for driving the display section 4.

The computation IC 10 further carries out the process of supplying the temperature measurement IC 40 and the drawing IC 30 with electric power, the process of reading a measured temperature from the temperature measurement IC 40, and the process of determining a period for which drive pulses that drive the display section 4 are applied and timing at which the drive pulses are applied to the drive section 4 based on the read measured temperature.

Further, the computation IC 10 has a normal action mode and a sleep mode. In the normal action mode, the computation IC 10 operates in synchronization with a clock signal outputted by an oscillation circuit (for example, CR oscillation circuit formed of capacitor C and resistor R) built in the computation IC 10, and in the sleep mode, the oscillation circuit stops operating so that the computation IC 10 consumes a smaller amount of power than in the normal action mode. To achieve low power consumption, the computation IC 10 operates in the normal action mode when it carries out the process of updating the display in the display section 4, whereas when the computation IC 10 carries out none of the processes described above, the computation IC 10 unloads the current mode information and data in use to a RAM (random access memory, not shown) built in the computation IC 10 and is on standby in the sleep mode. For example, when the time display mode is selected, the computation IC 10 in the normal action mode transmits drawing information (macro instruction) on an image to be displayed in the display section 4 to the drawing IC 30, causes a timer 22, which is provided in the real time clock IC 20, to start measurement, and then transitions to the sleep mode. The computation IC 10 in the sleep mode receives an interrupt signal INT, which represents that the timer 22 has measured a predetermined period (completed measurement), from the real time clock IC 20 (measurement completion signal) and transitions to the normal action mode.

The computation IC 10 may further carry out, for example, the process of reading a measured temperature from the temperature measurement IC 40 and determining whether or not a high temperature limit or a low temperature limit until which the device can normally operate has been reached and the process of monitoring the voltage across the primary battery 60 and determining whether or not a low voltage limit has been reached.

In the present embodiment, the computation IC 10 executes a program stored in advance in the flash ROM 12 to carry out the processes described above but may instead receive the program over a network from a server connected to the network and stores the program in an internal memory, followed by execution of the program. Still instead, the electronic timepiece 1 may be so configured that it can be connected to an information storage medium, such as a memory card, and the computation IC 10 may execute a program stored in the information storage medium to carry out the processes described above.

The real time clock IC 20, which serves as a time measurement section, causes a quartz vibrator 24 to oscillate to generate, for example, a 32,768-Hz oscillation signal and measures time, such as seconds, minutes, and hours, and dates, such as days, months, and years, by using a clock signal produced by division of the oscillation signal to generate time information containing the seconds, minutes, hours, days, months, years, and other parameters. That is, the real time clock IC 20 functions as a time measurement section. The time information is stored in a register (not shown) built in the real time clock IC 20, and the real time clock IC 20 transmits part or entirety of the time information stored in the register to the computation IC 10 in response to a request from the computation IC 10.

Further, the real time clock IC 20 causes the timer 22 to start measurement in response to a request from the computation IC 10 and transmits the interrupt signal INT when the timer 22 completes the measurement (measurement completion signal) to the computation IC 10. The period measured by the timer 22 may be a fixed period or may be a period specified by the computation IC 10.

The drawing IC 30 carries out the process of developing image data for deleting the current image in a VRAM (video RAM) 34, which is built in the drawing IC 30, in response to an instruction to execute the image deletion macro instruction from the computation IC 10 and the process of developing image data for displaying a new image in the VRAM in response to an instruction to execute the new image drawing macro instruction from the computation IC 10. The drawing IC 30 further carries out the process of supplying the display section 4 with electric power and transferring the image data developed in the VRAM 34 to the display section 4 and the process of causing a voltage boosting circuit 36 built in the drawing IC 30 to boost external power supply voltage (3 V, for example) to high voltage (15 V, for example) and generating drive pulses formed of the high voltage to drive the display section 4.

The flash ROM 32 built in the drawing IC 30 stores image data on images to be displayed in the display section 4 (for example, image data for performing the display shown in FIG. 1, such as "Eight" and "thirty-three") and other types of image data. That is, the flash ROM 32 functions as an image storage section and stores hour image data corresponding to each hour and minute image data corresponding to each minute. The flash ROM 32 further stores the macro instruction for deleting an image displayed in the display section 4 (image deletion macro instruction) and the macro instruction for drawing a new image in the display section 4 (new image drawing macro instruction). Each of the image deletion macro instruction and the new image drawing macro instruction contains information on image data to be drawn and the coordinates thereof (coordinates at which origin of each image data should be located), information on background data to be drawn, or other types of information. When receiving an instruction to execute any of the macro instructions transmitted from the computation IC, the drawing IC 30 reads image data stored in the flash ROM 32 in accordance with the image deletion macro instruction or the new image drawing macro instruction stored at the specified address in the flash ROM 32 and writes each selected part at an address in the VRAM 34 that corresponds to the coordinates at which the part should be displayed in a display area of the display section 4.

The drawing IC 30 further uses the reference signal (4 kHz, for example) supplied from the computation IC 10 to adjust the application (transmission) timing and the pulse width of the drive pulses. The drawing IC 30 further has an oscillation circuit (not shown) built therein, such as a CR oscillation circuit, and the oscillation circuit generates a clock signal having a relatively high frequency (400 kHz, for example) and uses the clock signal to carry out the processes described above except the process of generating the drive pulses. The thus functioning drawing IC 30, which uses the reference signal having a frequency (4 kHz, for example) sufficiently lower than the frequency of the clock signal generated by the built-in oscillation circuit to adjust the application (transmission) timing and the pulse width of the drive pulses, achieves low power consumption.

When the time display mode is selected, the real time clock IC 20 transmits, when the 00 second of each minute is exactly reached, a 00-second notification signal to the computation IC 10, and the computation IC 10 receives the notification signal and instructs the drawing IC 30 to apply (transmit) the drive pulses to the display section 4. Having received the instruction, the drawing IC 30 applies (transmits) the drive pulses to the display section 4. Having received the drive pulses, the display section 4 displays a new image (image containing time incremented by one minute). As described above, in the time display mode, synchronizing the update of an image displayed in the display section 4 with the accurate notification signal transmitted by the real time clock IC 20 as described above allows the displayed time to start changing at more accurate timing than in a case where the image update is synchronized with the asynchronous clock signal generated by the drawing IC 30.

The temperature measurement IC 40 operates with electric power supplied from the computation IC 10 and carries out the process of measuring the temperature in response to a request from the computation IC 10, causing an A/D converter (not shown) built in the temperature measurement IC 40 to convert a measured temperature into a digital value, and transmitting the digital value to the computation IC 10.

C: Configurations of Display Section and Drawing IC

Figure 3:
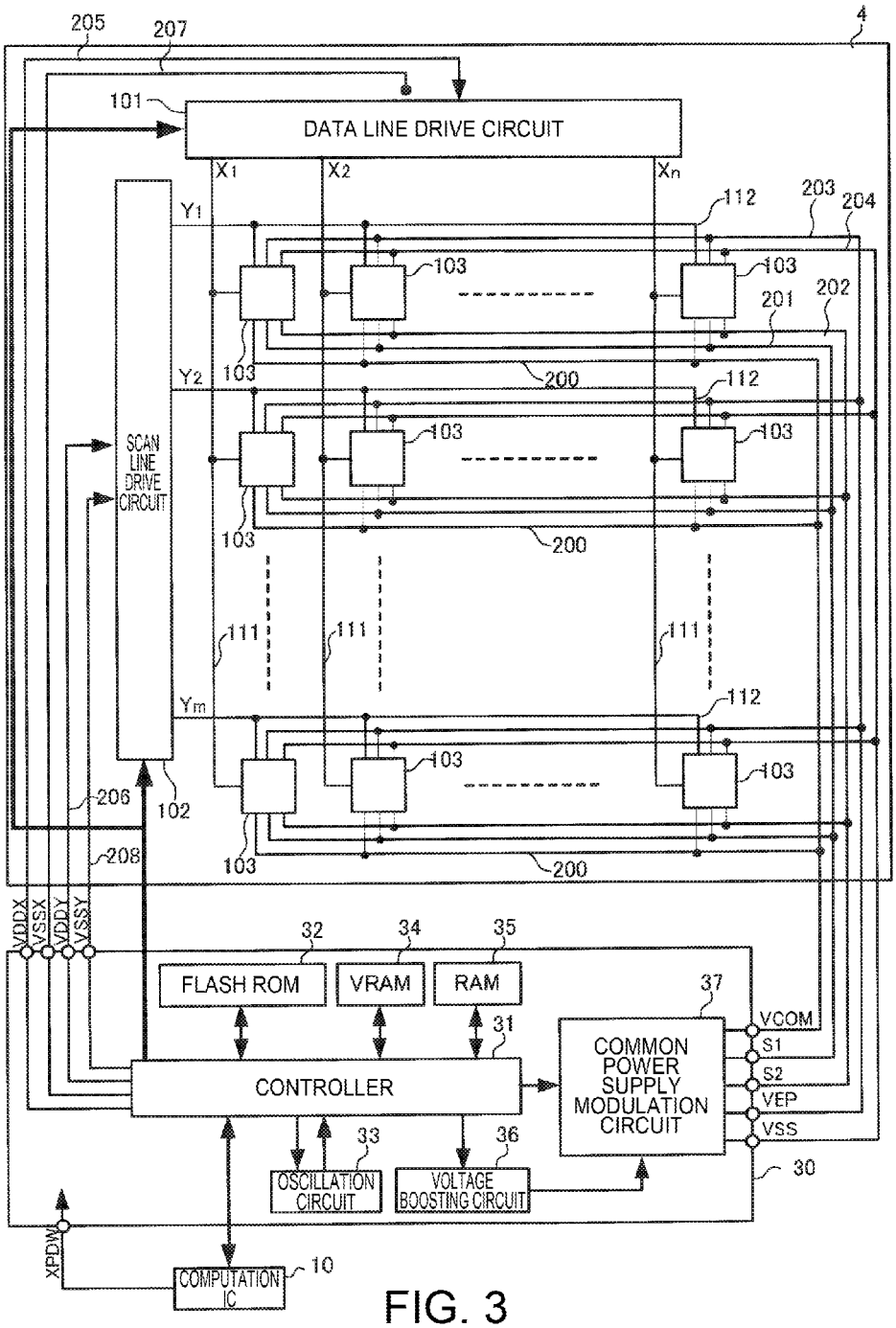
FIG. 3 shows the configurations of a display section and a drawing IC according to the first embodiment.

FIG. 3 shows the configurations of the display section 4 and the drawing IC 30 according to the present embodiment. The display section 4 according to the present embodiment is an active-matrix electrophoretic display panel (EPD panel) and can display a variety of images, such as a character, a numeral, a photograph, a pattern, and an illustration.

The display section 4 is provided with a data line drive circuit 101 and a scan line drive circuit 102. In the display section 4 are further formed a plurality of data lines 111, which extend from the data line drive circuit 101, and a plurality of scan lines 112, which extend from the scan line drive circuit 102, and a plurality of pixels 103 are provided in correspondence with the intersections of the data lines and the scan lines.

The data line drive circuit 101 is connected to the pixels 103 via n data lines 111 (X1, X2, . . . , and Xn). The data line drive circuit 101 supplies each of the pixels 103 with an image signal that specifies 1-bit image data corresponding to that pixel 103. It is assumed in the present embodiment that the data line drive circuit 101 supplies a pixel 103 with a low-level image signal to specify image data of "0", whereas supplying a pixel 103 with a high-level image signal to specify image data of "1".

The scan line drive circuit 102 is connected to the pixels 103 via m scan lines 112 (Y1, Y2, . . . , and Ym). The scan line drive circuit 102 sequentially selects one of the scan lines 112 from the first row to the m-th row under the control of a controller 31 to supply the corresponding pixel 103 with a selection signal that specifies ON timing at which a drive TFT 104 (see FIG. 4), which is provided in the pixel 103, is turned on.

The display section 4 is provided with a high potential power supply line 205, which extends from the controller 31 via a VDDX terminal of the drawing IC 30, and the high potential power supply line 205 is connected to the data line drive circuit 101. The display section 4 is further provided with a high potential power supply line 206, which extends from the controller 31 via a VDDY terminal of the drawing IC 30, and the high potential power supply line 206 is connected to the scan line drive circuit 102. The controller 31 controls whether or not high potential (5 V) is supplied to the high potential power supply lines 205 and 206.

The display section 4 is further provided with a low potential power supply line 207, which extends from the controller 31 via a VSSX terminal of the drawing IC 30, and the low potential power supply line 207 is connected to the data line drive circuit 101. The display section 4 is further provided with a low potential power supply line 208, which extends from the controller 31 via a VSSY terminal of the drawing IC 30, and the low potential power supply line 208 is connected to the scan line drive circuit 102. The controller 31 supplies the low potential power supply lines 207 and 208 with low potential (0 V).

The display section 4 is further provided with a common electrode wiring line 200, a first pulse signal line 201, a second pulse signal line 202, a high potential power supply line 203, and a low potential power supply line 204, which extend from a common power supply modulation circuit 37 via a VCOM terminal, an S1 terminal, an S2 terminal, a VEP terminal, and a VSS terminal of the drawing IC 30, respectively, and each of the wiring lines is connected to the pixels 103. The common power supply modulation circuit 37 generates a variety of signals to be supplied to the wiring lines described above and performs electrical connection and disconnection (provision of high impedance, Hi-Z) of the wiring lines under the control of the controller 31.

The drawing IC 30 includes the controller 31, the flash ROM 32, an oscillation circuit 33, the VRAM 34, a RAM 35, the voltage boosting circuit 36, and the common power supply modulation circuit 37. The controller 31 keeps being powered off until an enable signal (high-level signal) is inputted from the computation IC 10 to an enable terminal XPDW and is powered on when the enable signal is inputted. The controller 31 in the power-on state uses the RAM 35 as a work area and controls the flash ROM 32, the oscillation circuit 33, the VRAM 34, the voltage boosting circuit 36, and the common power supply modulation circuit 37 to carry out processes for displaying an image in the display section 4.

Figure 4:
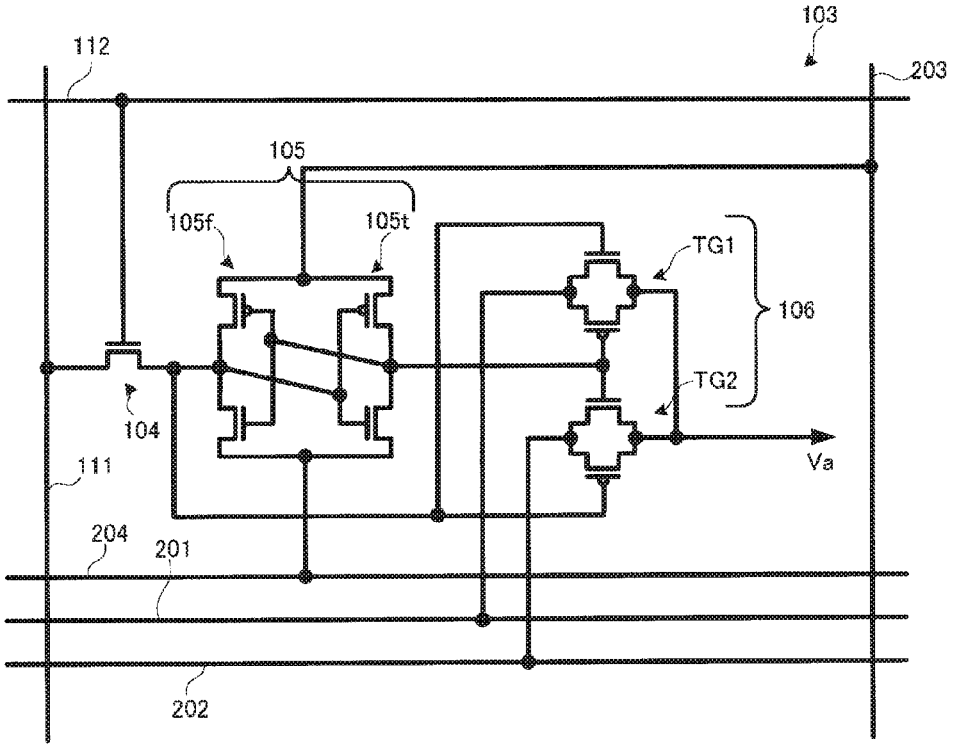
FIG. 4 is a circuit configuration diagram of a pixel according to the first embodiment.

FIG. 4 is a circuit configuration diagram of each of the pixels 103 shown in FIG. 3. The same wiring lines as those in FIG. 3 have the same reference numerals and will not be described. Further, the common electrode wiring line 200, which is common to all the pixels, is not shown.

The pixel 103 is provided with a drive TFT (thin film transistor) 104, a latch circuit 105, and a switch circuit 106, as shown in FIG. 4. The pixel 103 has an SRAM configuration (SRAM: static random access memory) in which the latch circuit 105 holds an image signal in the form of potential.

The drive TFT 104 is a pixel switching device formed of an N-channel MOS (metal oxide semiconductor) transistor. The drive TFT 104 has a gate terminal connected to one of the scan lines 112, a source terminal connected to one of the data lines 111, and a drain terminal connected to a data input terminal of the latch circuit 105. The latch circuit 105 includes a transfer inverter 105*t* and a feedback inverter 105*f*. To the transfer inverter 105*t* and the feedback inverter 105*f* is supplied power supply voltage corresponding to the difference in potential between the high potential power supply line 203 and the low potential power supply line 204.

The switch circuit 106 is formed of transmission gates TG1 and TG2 and outputs a signal to a pixel electrode 135 (see FIGS. 5B and 5C) in accordance with the level of image data stored in the latch circuit 105.

When image data of "1" (high-level image signal) is stored in the latch circuit 105 so that the transmission gate TG1 is turned on, the switch circuit 106 outputs a signal propagating to the first pulse signal line 201. On the other hand, when image data of "0" (low-level image signal) is stored in the latch circuit 105 so that the transmission gate TG2 is turned on, the switch circuit 106 outputs a signal propagating to the second pulse signal line 202. The circuit configuration described above can control the potential to be supplied to the pixel electrode 135 in each of the pixels 103.

Figure 5A:
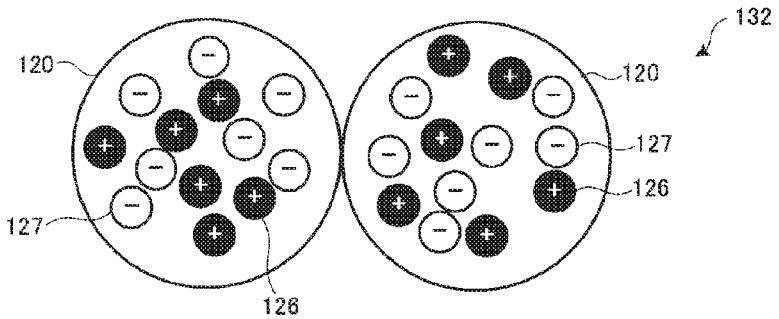
FIG. 5A shows an example of the configuration of an electrophoretic device.

In the present embodiment, the display section 4 has a plurality of two-particle-system, microcapsule-type electrophoretic devices, and the color of each of the pixels 103 is controlled by application of an electric field to the corresponding electrophoretic device. FIG. 5A shows the configuration of an electrophoretic device 132 according to the present embodiment. The electrophoretic devices 132 are disposed between a device substrate 130 and a counter substrate 131 (see FIGS. 5B and 5C). The electrophoretic devices 132 are formed of an array of a plurality of microcapsules 120. Each of the microcapsules 120 has, for example, the following components sealed therein: a colorless transparent dispersion liquid; a plurality of white electrophoretic particles (white particles 127); and a plurality of black electrophoretic particles (black particles 126). In the present embodiment, the white particles 127 are negatively charged, and the black particles 126 are positively charged. The colors of the electrophoretic particles may instead be red and white or any other color combination in place of black and white. Further, in the present specification, a state in which a certain object is "colorless" is a state in which the color of a target viewed through the object can be recognized to be substantially the same as the color of the target viewed without the object. Further, a state in which a certain object is "transparent" is a state in which a target can be visually recognized through the object.

Figure 5B:
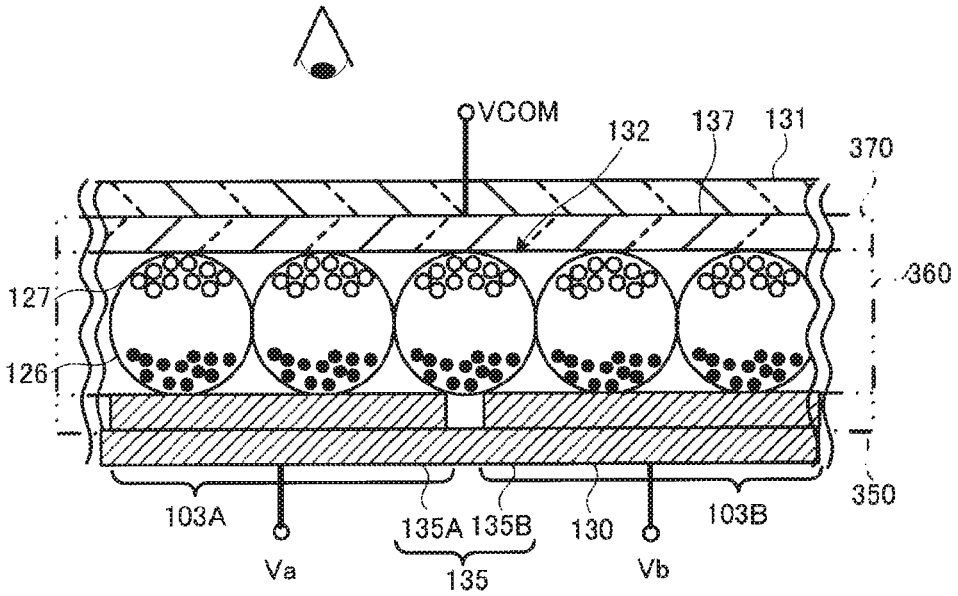
FIG. 5B describes action of the electrophoretic device.

FIG. 5B is a partial cross-sectional view of the display section 4. The device substrate 130 and the counter substrate 131 sandwich the electrophoretic devices 132 formed of an array of the microcapsules 120. In the display section 4, a drive electrode layer 350, in which a plurality of pixel electrodes 135 are formed, is provided on one side of the device substrate 130 that faces the electrophoretic devices 132. FIG. 5B shows a pixel electrode 135A and a pixel electrode 135B as the pixel electrodes 135. The pixel electrodes 135 can supply potential (Va, Vb, for example) on a pixel basis. In the following description, a pixel having the pixel electrode 135A is called a pixel 103A, and a pixel having the pixel electrode 135B is called a pixel 103B. The pixel 103A and the pixel 103B are two pixels corresponding to the pixels 103 (see FIGS. 3 and 4).

On the other hand, the counter substrate 131 is a transparent substrate. In the display section 4, an image is displayed on the side facing the counter substrate 131. In the display section 4, a common electrode layer 370, in which a planar common electrode 137 is formed, is provided on one side of the counter substrate 131 that faces the electrophoretic devices 132. The common electrode 137 is a transparent electrode. The common electrode 137 is an electrode common to all the pixels, unlike the pixel electrodes 135, and potential VCOM is supplied to the common electrode 137.

The electrophoretic devices 132 are disposed in an electrophoretic display layer 360 provided between the common electrode layer 370 and the drive electrode layer 350, and the electrophoretic display layer 360 serves as the display area. A desired color can be displayed on a pixel basis in accordance with the difference in potential between the pixel electrode 135 (135A, 135B, for example) and the common electrode 137.

FIG. 5B shows a state in which the potential VCOM at the common electrode is higher than the potential Va at the pixel electrode 135A in the pixel 103A and the potential Vb at the pixel electrode 135B in the pixel 103B. In this state, since negative voltage with respect to the potential VCOM is applied between the pixel electrodes 135A, 135B and the common electrode 137, the negatively charged white particles 127 are attracted toward the common electrode 137, and the positively charged black particles 126 are attracted toward the pixel electrodes 135A and 135B. The pixels 103A and 103B are therefore visually recognized to display white (example of first color).

Figure 5C:
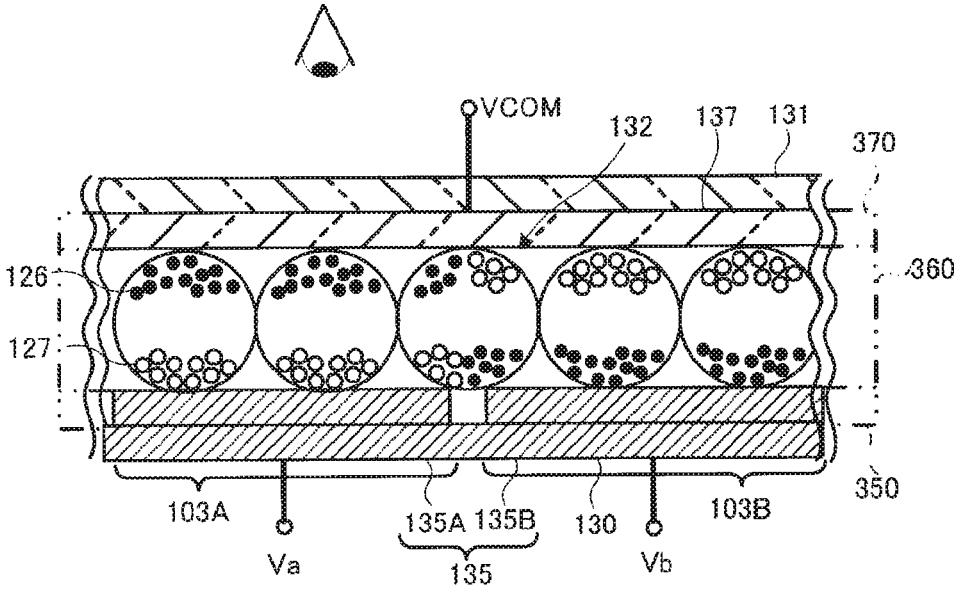
FIG. 5C describes action of the electrophoretic device.

FIG. 5C shows a state which is changed from the state in FIG. 5B and in which the potential VCOM at the common electrode 137 is lower than the potential Va at the pixel electrode 135A in the pixel 103A and is equal to the potential Vb at the pixel electrode 135B in the pixel 103B. In this state, since positive voltage with respect to the potential VCOM is applied between the pixel electrode 135A and the common electrode 137, the positively charged black particles 126 are attracted toward the common electrode 137, and the negatively charged white particles 127 are attracted toward the pixel electrode 135A. The pixel 103A is therefore visually recognized to have changed from white to black (example of second color). On the other hand, since there is no potential difference between the pixel electrode 135B and the common electrode 137, the black particles 126 and the white particles 127 hardly move but remain in the positions in FIG. 5B. The pixel 103A is therefore visually recognized not to have changed but to have remained white.

It is noted that an arbitrary intermediate color between black and white (gray) can also be displayed. To this end, the magnitude of the difference in potential between the pixel electrodes 135 and the common electrode 137 or the period for which the difference in potential is created is so controlled that the black particles 126 and the white particles 127 are stationary in an arbitrary intermediate position between the two electrodes.

As described above, an EPD panel, which not only allows an image to be held with no electric power supplied for a fixed period for low-power-consumption action but also allows 180-degree visual recognition, is also suitably used as a display section of a portable electronic timepiece, such as a wristwatch.

D: Image Updating Method

Figure 6:
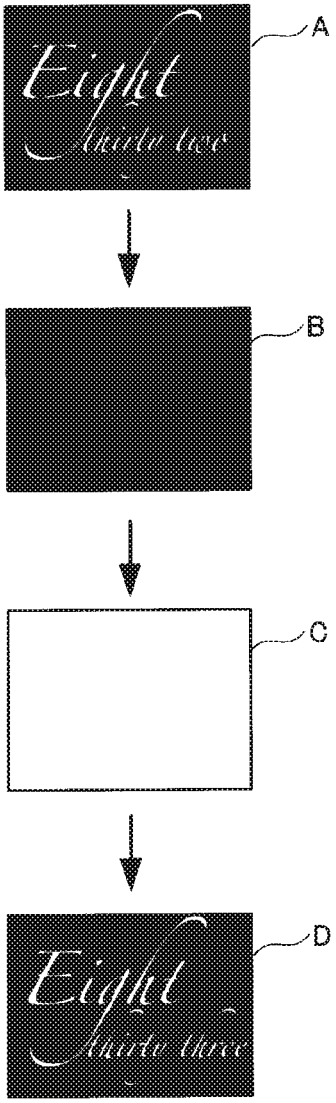
FIG. 6 describes a method for updating an image in the display section.

FIG. 6 describes a method for updating an image in the display section 4. FIG. 6 shows an example in which the displayed time is updated every minute.

In the example in FIG. 6, first, when it is 8:32, the display section 4 shows an image A in which the pixels in the display positions of "Eight" and "thirty-two" show white and the other pixels show black.

Next, a short time before it is 8:33, the display section 4 displays an entirely black image B. To update the image A to the image B, an entirely black image is displayed by using a partial drive method for applying no voltage to the black pixels (applying zero voltage) but applying negative voltage to the white pixels, and the entirely black image is then displayed again by using an overall drive method for applying negative voltage to all the pixels. The overall drive method is a drive method for creating a potential difference (between common electrode 137 and pixel electrodes 135) in all the pixels for a period of driving (drawing) operation using the method.

The display section 4 then displays an entirely white image C. To update the image B to the image C, an entirely white image first is displayed by using the overall drive method for applying positive voltage to all the pixels, and the entirely white image is then displayed again by using the partial drive method for applying no voltage to the pixels having shown white in the image A (applying zero voltage) but applying positive voltage to the pixels having shown black in the image A. The partial drive method is a drive method for allowing presence of pixels where no potential difference (between common electrode 137 and pixel electrodes 135) is created for a period of driving (drawing) operation using the method.

Next, when it is 8:33, the display section 4 shows an image D in which the pixels in the display positions of "Eight" and "thirty-three" show white and the other pixels show black. To update the image C to the image D, the image D is displayed by using the partial drive method for applying negative voltage to the pixels that are not located in the display positions of "Eight" and "thirty-three" but applying no voltage to the pixels that are located in the display positions of "Eight" and "thirty-three" (applying zero voltage).

As described above, in the present embodiment, the partial drive method and the overall drive method are used to display an entirely black image and the overall drive method and the partial screen drive method are further used to display an entirely white image to delete a current image, and then the partial drive method is used to display a next image (new image). That is, in the image updating method according to the present embodiment, which first creates the state in which all the pixels show white and then displays a next image, a problem of color tone variation among images is unlikely to occur. Further, the image updating method according to the present embodiment, in which the time average of the electric field applied between each of the pixel electrodes 135 and the common electrode 137 is roughly zero and the DC balance is therefore achieved, ensures long-term reliability of the electrophoretic display device 7.

A drive period necessary to delete an image or draw a new image (drive pulse application period) in the display section 4 (EPD panel) changes with temperature, and the necessary drive period typically increases as the temperature decreases. In view of the fact described above, in the present embodiment, the drive period is changed in accordance with the temperature when an image is updated. To this end, the flash ROM 12 built in the computation IC 10 stores table information representing the relationship between the temperature and the drive pulse application period.

The computation IC 10 acquires a measured temperature from the temperature measurement IC 40 before an image is updated, refers to the table information stored in the flash ROM 12, and instructs an appropriate drive pulse application period according to the temperature when instructing the drawing IC 30 to transfer image data to the display section 4.

E: Display Process

An hour and minute displaying process according to the present embodiment will next be described with reference to FIGS. 7 to 13.

Figure 7:
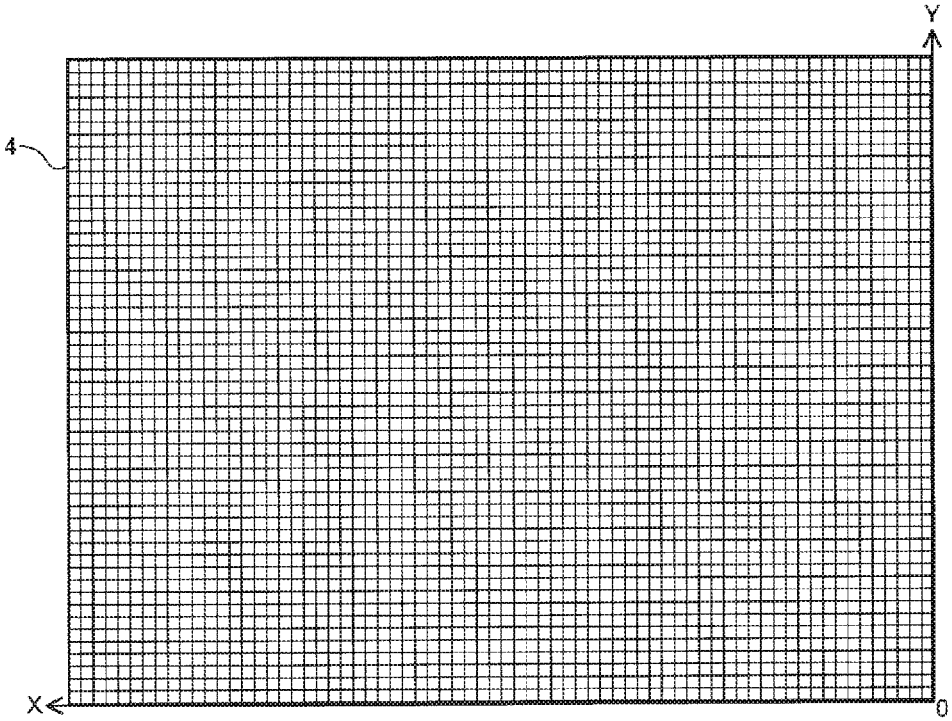
FIG. 7 describes display positions in a display area of the display section.

The display positions in the display area of the display section 4 in the present embodiment are set at predetermined grid intervals and expressed by XY coordinates with an origin located at the lower right corner, as shown in FIG. 7. Image data includes hour image data 70 corresponding to the hours of hours and minutes and minute image data 80 corresponding to the minutes of the hours and minutes.

Figure 8:
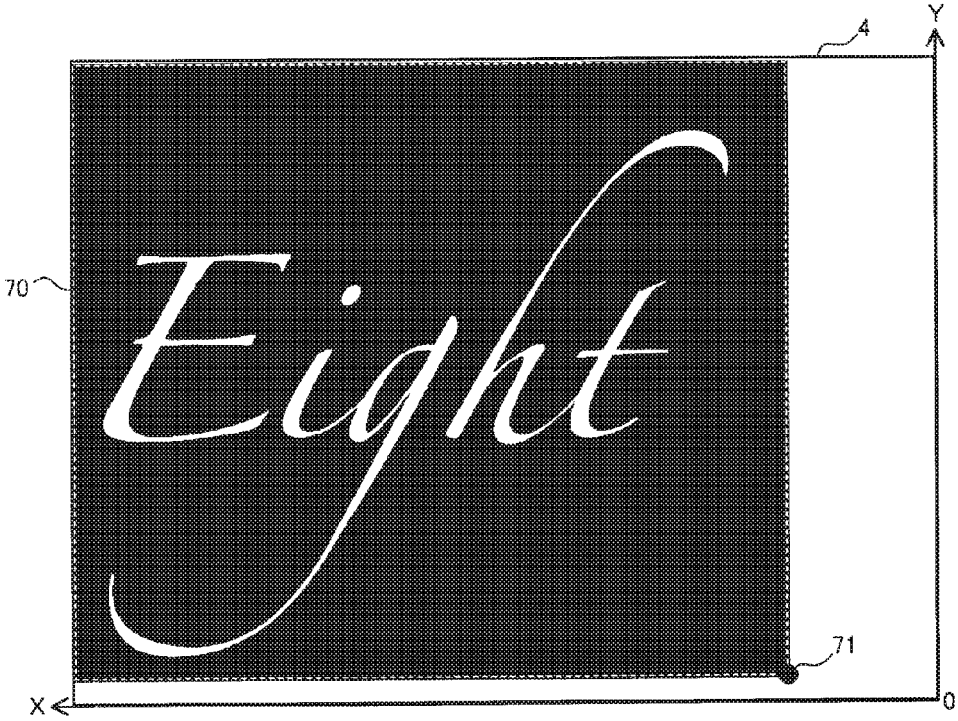
FIG. 8 shows an example of the font of hour image data.

The hour image data 70 is configured, for example, in the form of an image in which the numerals from 1 to 12 corresponding to the hours are expressed in English as one, two, . . . , twelve drawn in a cursive script, as shown in FIG. 8. The size of the hour image data 70 expressed in the lengths in the X and Y directions varies in accordance with the number of characters and the shape of the font. Each of the hour image data sets 70 has a preset origin 71, and the display position of the hour image data 70 is determined by the coordinates of the origin 71 in the display section 4.

Figure 9:
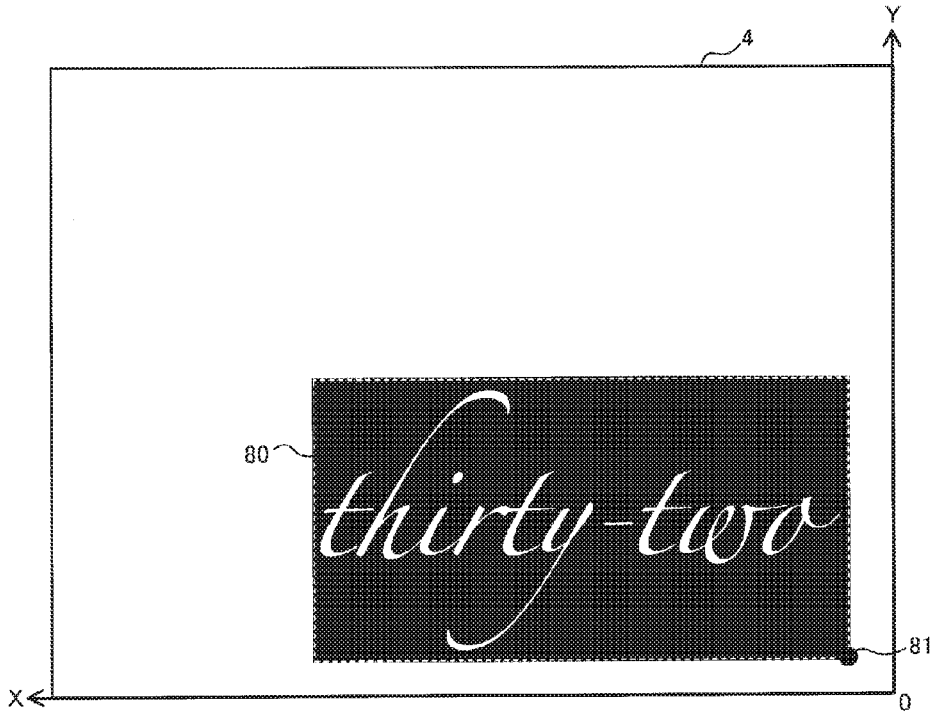
FIG. 9 shows an example of the font of minute image data.

The minute image data 80 is configured, for example, as in the case of the hour image data 70, in the form of an image in which the numerals from 0 to 59 corresponding to the minutes are expressed in English as one, two, . . . , fifty-nine drawn in a cursive script, as shown in FIG. 9. The size of the minute image data 80 expressed in the lengths in the X and Y directions varies in accordance with the number of characters and the shape of the font. Each of the minute image data sets 80 has a preset origin 81, and the display position of the minute image data 80 is determined by the coordinates of the origin 81 in the display section 4.

In the present embodiment, the computation IC 10 refers to a minute display table 90 shown in FIG. 10, an hour display table 91 shown in FIG. 11, and an hour display position adjustment table 92 shown in FIG. 12 to display the hour image data 70 and the minute image data 80. The minute display table, the hour display table, and the hour display position adjustment table correspond to display tables in an embodiment of the invention.

The minute display table 90 describes macro names corresponding to the minutes, image names corresponding to the macro names (information that identifies minute image data used to display predetermined minute), and X and Y coordinates (information that identifies display position of minute image data), as shown in FIG. 10. For example, the macro name corresponding to the minute of 32 is EMAC_MINUTE_A_32. The macro name is used as information that identifies a macro instruction, and the flash ROM 32 stores a macro instruction corresponding to each of the macro names in advance. The computation IC 10 reads a macro name from the minute display table 90 based on time information from the real time clock IC 20 and outputs an instruction to execute a macro instruction corresponding to the read macro name to the drawing IC 30. The drawing IC 30 reads, from the flash ROM 32, the macro instruction corresponding to the execution instruction outputted from the computation IC 10 and executes the macro instruction. A macro instruction contains an image name and X and Y coordinates described in the minute display table 90, and minute image data 80 corresponding to the image name is so displayed that the origin of the minute image data 80 is located at the coordinates indicated by the X and Y coordinates. The position where minute image data is displayed can thus be changed in accordance with a minute to be displayed.

Further, for example, the image name corresponding to the minute of 32 is MINUTE_A_32.bmp, and the flash ROM 32 stores minute image data corresponding to each image name.

The hour display table 91 describes adjustment numbers in correspondence with combinations of the hours and minutes, as shown in FIG. 11. The hour display position adjustment table 92 describes macro names corresponding to the adjustment numbers, image names corresponding to the macro names (information that identifies hour image data used to display predetermined hour), and X and Y coordinates (information that identifies display position of hour image data), as shown in FIG. 12. For example, the adjustment number corresponding to 8:29 is "22". The macro name corresponding to the adjustment number "22" is EMAC_APPEND_A_022. The macro name described in the hour display position adjustment table 92 is used as information that identifies a macro instruction, and the flash ROM 32 stores a macro instruction corresponding to each of the macro names in advance. The computation IC 10 reads a macro name from the hour display position adjustment table 92 based on time information from the real time clock IC 20 and outputs an instruction to execute a macro instruction corresponding to the read macro name to the drawing IC 30. The drawing IC 30 reads, from the flash ROM 32, the macro instruction corresponding to the execution instruction outputted from the computation IC 10 and executes the macro instruction. A macro instruction contains an image name and X and Y coordinates described in the hour display position adjustment table 92, and hour image data 70 corresponding to the image name is so displayed that the origin of the hour image data 70 is located at the coordinates indicated by the X and Y coordinates. The hour display table 91 and the hour display position adjustment table 92 allow the display position of hour image data to be changed in accordance with an hour to be displayed and further allow the display position of the same hour image data can be changed in accordance with a minute to be displayed.

The image name corresponding to the adjustment number "22" is HOUR_B_08.bmp, and the flash ROM 32 stores hour image data corresponding to each of the image names.

Although not shown, in the present embodiment, in which the time is displayed by using numerals from one to twelve, characters "AM" and "PM", which represents the morning and afternoon, respectively, are displayed in a layer different from a layer where the time is displayed.

Figure 13:
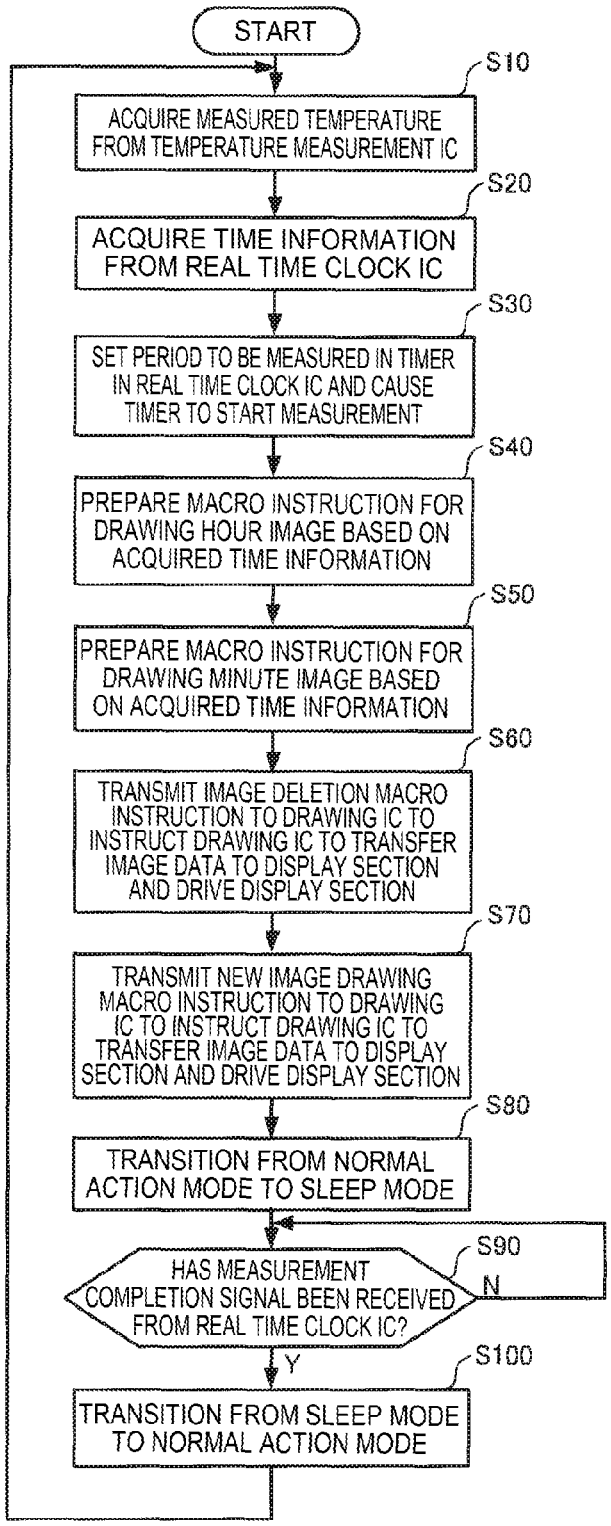
FIG. 13 is a flowchart showing the procedure of a display process.

The procedure of the display process in the present embodiment will next be described with reference to the flowchart in FIG. 13. FIG. 13 is a flowchart showing a summary of the display process carried out by the computation IC 10. The computation IC 10 first acquires a measured temperature from the temperature measurement IC 40 (S10) in the normal action mode, as shown in FIG. 13.

The computation IC 10 then acquires time information from the real time clock IC 20 (S20). The computation IC 10 sets a period to be measured in the timer 22 provided in the real time clock IC 20 and causes the timer 22 to start the measurement (S30). In the present embodiment, the period to be measured is set at a value smaller than one minute, for example, about 50 seconds so that the process of drawing an image in the display section 4 carried out in step S70 is carried out every minute.

The computation IC 10 then reads an adjustment number from the hour display table 91 in preparation for drawing of an hour image based on the time information acquired in step S20 and reads a macro name from the hour display position adjustment table 92 based on the adjustment number to prepare a necessary macro instruction (S40). The macro instruction also contains the image deletion macro instruction.

Similarly, the computation IC 10 reads a macro name from the minute display table 90 in preparation for drawing of a minute image based on the time information acquired in step S20 to prepare a necessary macro instruction (S50). The macro instruction also contains the image deletion macro instruction.

The computation IC 10 then transmits an instruction to execute the image deletion macro instruction to the drawing IC 30 to instruct the drawing IC 30 to transfer image data to the display section 4 and drive the display section 4 (S60). The drawing IC 30 deletes the image in the display section 4 based on the macro instruction.

The computation IC 10 then transmits an instruction to execute the new image drawing macro instruction to the drawing IC 30 to instruct the drawing IC 30 to transfer image data to the display section 4 and drive the display section 4 (S70). The drawing IC 30 updates the image in the display section 4 based on the macro instruction.

The computation IC 10 then transitions from the normal action mode to the sleep mode (S80) and is in standby until the computation IC 10 receives the measurement completion signal (interrupt signal) from the real time clock IC 20 (N in S90).

When the timer 22 completes the measurement, the real time clock IC 20 transmits the measurement completion signal (interrupt signal) to the computation IC 10. Having received the measurement completion signal (interrupt signal) (Y at A90), the computation IC 10 transitions from the sleep mode to the normal action mode (S100) and carries out the processes in step S10 and the following steps again.

F: Display Position Adjustment Process

The process of adjusting the display position of hour image data in the present embodiment will next be described with reference to FIGS. 14 to 17. The font used in the present embodiment is an English cursive font, as shown in FIGS. 8 and 9, and has a portion elongated in one of the upward, downward, rightward, and leftward directions depending on a character. Further, the Y coordinate of the origin 71 of the hour image data 70 and the Y coordinate of the origin 81 of the minute image data 80 differ from each other and are separated from each other in the vertical direction. A displayed hour and minute are therefore undesirably very hard to read depending on a combination of words representing numerals.

Figure 14:
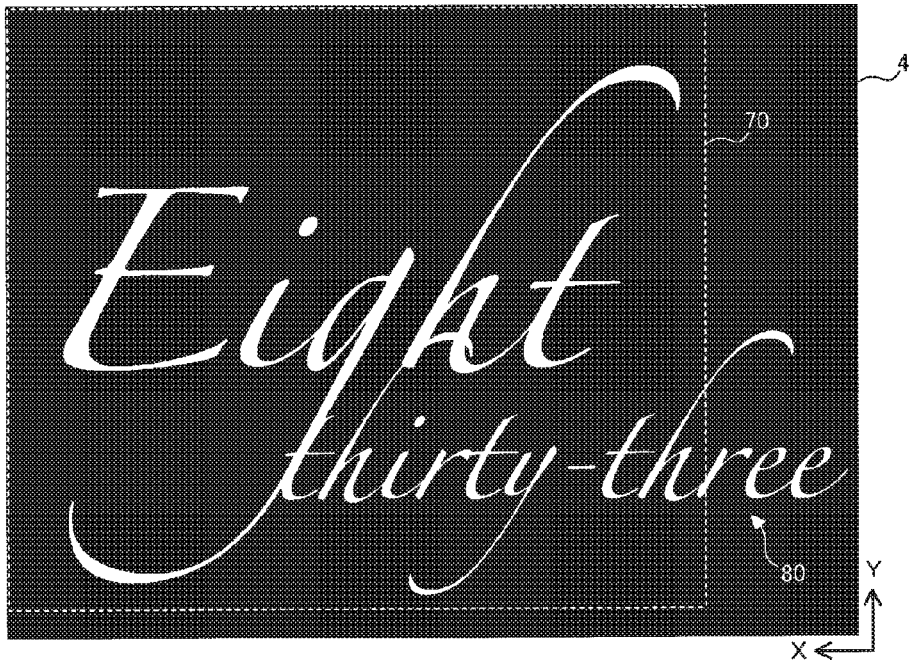
FIG. 14 shows an example of display in the display section in a case where no hour display position adjustment is made.

For example, when it is 8:33, and "Eight" of the hour image data 70 is disposed in a standard position, a lower portion of the character "g" of "Eight" undesirably overlaps with the first character "t" of "thirty-three" of the minute image data 80, as shown in FIG. 14. Further, an upper portion of the second character "h" of "thirty-three" of the minute image data 80 undesirably overlaps with a lower portion of the character "h" of "Eight" of the hour image date 70. The "standard position" used herein is assumed to be a position determined in advance as the coordinates at which the origin 71 of the hour image date 70 of "Eight" shown in FIG. 14 is disposed.

Figure 16:
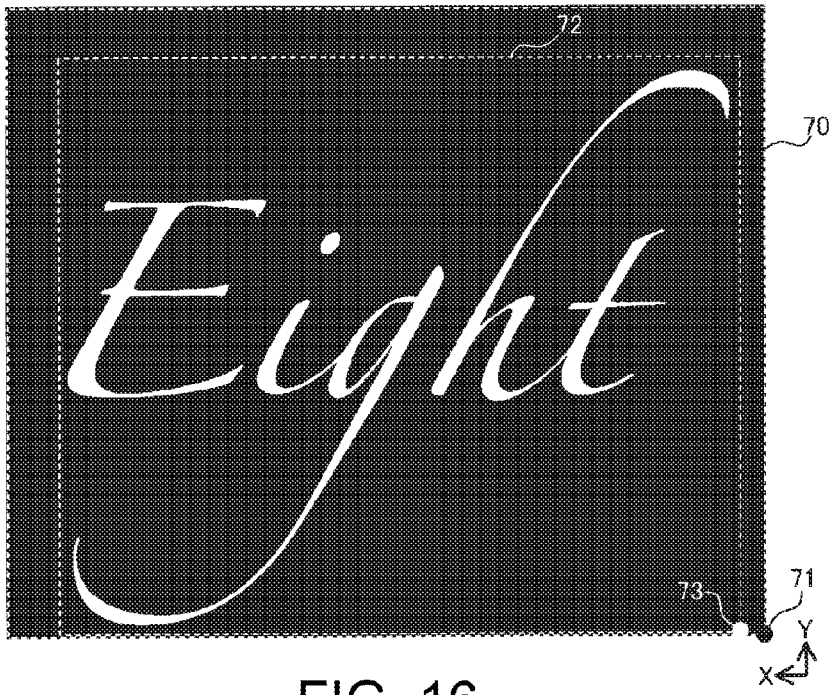
FIG. 16 shows an example of the hour image data.
Figure 17:
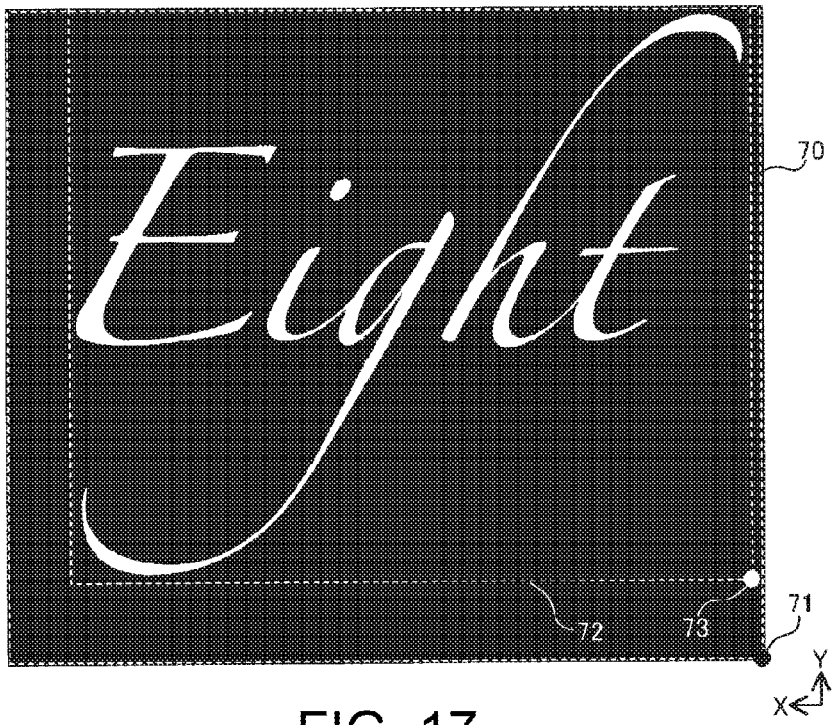
FIG. 17 shows another example of the hour image data.
Figure 18:
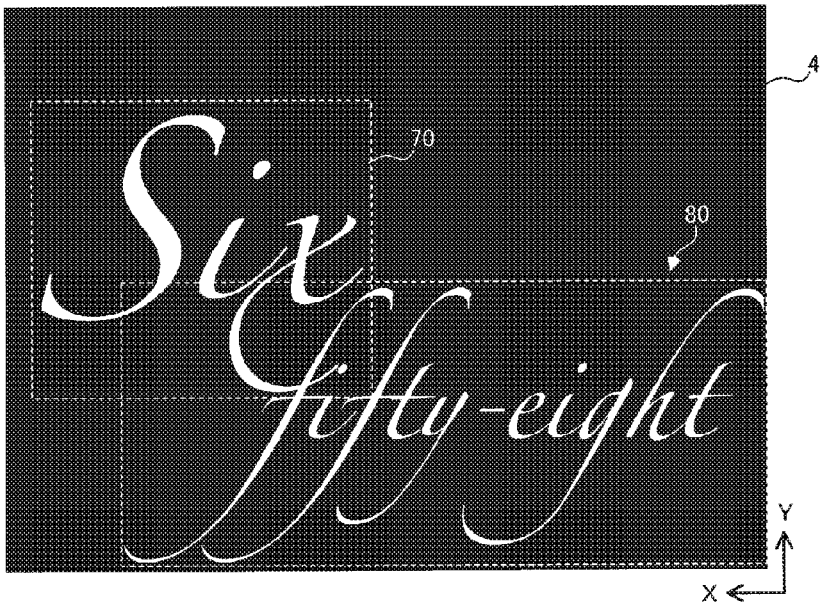
FIG. 18 shows an example of hour image data using a standard font displayed in the display section in a second embodiment of the invention.

To avoid the situation described above, in the present embodiment, two types of hour image data 70 of "Eight" are prepared as shown in FIGS. 16 and 17, and either of the two sets of the hour image data 70 of "Eight" is used in accordance with the minute image data 80.

The hour image data 70 of "Eight" shown in FIG. 16 is so configured that the coordinates of an origin 73 of a font 72 in the hour image data 70 is set in a position in the vicinity of the coordinates of the origin 71 of the hour image data 70 itself. On the other hand, the hour image data 70 of "Eight" shown in FIG. 17 is so configured that the coordinates of the origin 73 of the font 72 in the hour image data 70 is greatly shifted in the positive Y-axis direction and slightly shifted in the positive X-axis direction. The coordinates of the origin 73 of the font 72 in the hour image data 70 of "Eight" shown in FIG. 17 are therefore set to be farther from the coordinates of the origin 71 of the hour image data 70 itself than the origin 73 of "Eight" shown in FIG. 16.

In the present embodiment, the hour image data 70 shown in FIG. 17 is used as the hour image data 70 of "Eight" when the time to be displayed falls within a range from 8:30 to 8:39. Further, the hour image data 70 shown in FIG. 16 is used as the hour image data 70 of "Eight" when the time to be displayed falls within a range from 8:00 to 8:29 and a range from 8:40 to 8:59.

Figure 15:
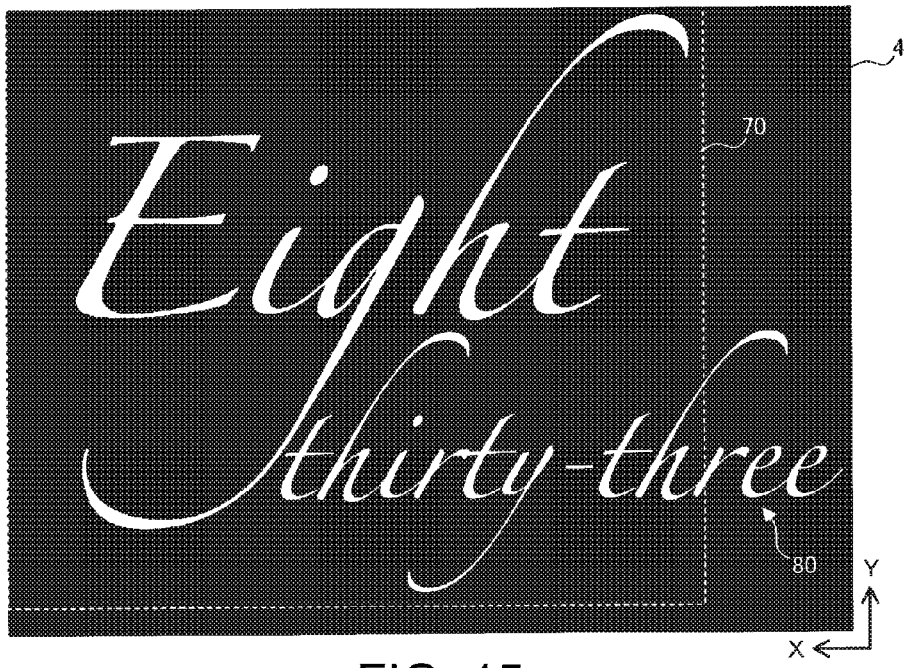
FIG. 15 shows an example of display in the display section in a case where hour display position adjustment is made.

The configuration described above allows the displayed hour and minute in a case where it is, for example, 8:33 to be legible with no overlap between the font of the hour image data 70 and the font of the minute image data 80, as shown in FIG. 15.

The two types of hour image data 70 of "Eight" are appropriately used as follows: First, the hour display table 91 describes the adjustment numbers corresponding to the hour of 8 as follows: The adjustment number is "22" over a range from 8:00 to 8:29 and a range from 8:40 to 8:59; and the adjustment number is "13" over a range from 8:30 to 8:39, as shown in FIG. 11. Similarly, the hour display table 91 describes the adjustment numbers corresponding to the hour of 20 as follows: The adjustment number is "35" over a range from 20:00 to 8:29 and a range from 20:40 to 8:59; and the adjustment number is "26" over a range from 20:30 to 20:39.

In the hour display position adjustment table 92 shown in FIG. 12, the macro name corresponding to the adjustment number of "22" is EMAC_APPEND_A022, and the image name corresponding to the macro name is HOUR_B_08.bmp. On the other hand, the macro name corresponding to the adjustment number of "13" is EMAC_APPEND_A013, and the image name corresponding to the macro name is HOUR_B_13.bmp.

Therefore, when the time to be displayed falls within the range from 8:00 to 8:29 or the range from 8:40 to 8:59, the computation IC 10 reads "22" as the adjustment number from the hour display table 91 and reads the macro name EMAC_APPEND_A022 from the hour display position adjustment table 92. The computation IC 10 then reads the macro instruction corresponding to the macro name EMAC_APPEND_A022 from the flash ROM 32 and outputs the macro instruction to the drawing IC 30. The drawing IC 30 executes the macro instruction corresponding to the macro name EMAC_APPEND_A022 to draw the image data HOUR_B_08.bmp as the hour image data 70. In this process, the drawing is so performed that the XY coordinates of the origin of the image data are (X08, Y08), that is, coordinates of a first position. HOUR_B_08.bmp corresponds to the hour image data 70 of "Eight" shown in FIG. 16.

As described above, the hour display table 91 contains information (adjustment number) that identifies, as a display position of a numeral specified by hour image data via the hour display position adjustment table 92, a position different from a predetermined standard position in accordance with the hour and minute even during the same hour.

On the other hand, when the time to be displayed falls within the range from 8:30 to 8:39, the computation IC 10 reads "13" as the adjustment number from the hour display table 91 and reads EMAC_APPEND_A013 as the macro name from the hour display position adjustment table 92. The computation IC 10 then reads the macro instruction corresponding to the macro name EMAC_APPEND_A013 from the flash ROM 32 and outputs the macro instruction to the drawing IC 30. The drawing IC 30 executes the macro instruction corresponding to the macro name EMAC_APPEND_A013 to draw the image data HOUR_B_13.bmp as the hour image data 70. In this process, the drawing is so performed that the XY coordinates of the origin of the image data are (X13, Y13), that is, the coordinates of a second position that differs from the first position. HOUR_B_13.bmp corresponds to the hour image data 70 of "Eight" shown in FIG. 17. As a result, when the time to be displayed falls within the range from 8:30 to 8:39, the hour image data 70 with the position of the font "Eight" adjusted is used and the displayed time can therefore be legible with no overlap between the font of the hour image data 70 and the font of the minute image data 80, as shown in FIG. 15.

Further, when the time to be displayed falls within the range from 20:00 to 20:29 or the range from 20:40 to 20:59, the computation IC 10 reads "35" as the adjustment number from the hour display table 91 and reads EMAC_APPEND_A035 as the macro name from the hour display position adjustment table 92. The computation IC 10 reads the macro instruction corresponding to the macro name EMAC_APPEND_A035 from the flash ROM 32 and outputs the macro instruction to the drawing IC 30. The drawing IC 30 executes the macro instruction corresponding to the macro name EMAC_APPEND_A035 to draw the image data HOUR_B_08.bmp as the hour image data 70. In this process, the drawing is so performed that the XY coordinates of the origin of the image data are (X08, Y08), that is, the coordinates of the first position.

On the other hand, when the time to be displayed falls within the range from 20:30 to 20:39, the computation IC 10 reads "26" as the adjustment number from the hour display table 91 and reads EMAC_APPEND_A026 as the macro name from the hour display position adjustment table 92. The computation IC 10 then reads the macro instruction corresponding to the macro name EMAC_APPEND_A026 from the flash ROM 32 and outputs the macro instruction to the drawing IC 30. The drawing IC 30 executes the macro instruction corresponding to the macro name EMAC_APPEND_A026 to draw the image data HOUR_B_13.bmp as the hour image data 70. In this process, the drawing is so performed that the XY coordinates of the origin of the image data are (X13, Y13), that is, the coordinates of the second position, which differs from the first position. HOUR_B_13.bmp corresponds to the hour image data 70 of "Eight" shown in FIG. 17. As a result, when the time to be displayed falls within the range from 20:30 to 20:39, the hour image data 70 with the position of the font "Eight" adjusted is used and the displayed time can therefore be legible with no overlap between the font of the hour image data 70 and the font of the minute image data 80, as shown in FIG. 15.

The present embodiment has been described with reference to the case where two types of hour image data 70 of "Eight" are prepared by way of example. Instead, three or more types of hour image data 70 may be prepared for the display of the same hour. Further, the present embodiment has been described with reference to the hour image data 70 of "Eight" corresponding to the display of the hour of 8 by way of example, and a plurality of types of hour image data 70 corresponding to other hours may also be prepared when a font used in the display of the other hours has an elongated portion. Further, a plurality of types of minute image data 80 may also be prepared, and minute image data 80 having a different font position may be used in accordance with the time to be displayed.

Further, in the present embodiment, hour image data is so prepared that the origin 73 thereof is set in a position separate from the standard position of "Eight," which is the origin 71 of the hour image data itself, but the origin 73 only needs to be set in a position where "Eight" is displayed appropriately in an aesthetic sense.

Further, the present embodiment has been described with reference to the case where two types of hour image data 70 in which the coordinates of the font "Eight" differ between the two types are prepared by way of example. Instead, only one type of hour image data 70 may be prepared, and the origin 71 of the hour image data 70 may be shifted in accordance with the minute image data 80, which is displayed simultaneously with the hour image data 70. Similarly, the origin of the minute image data 80 may be shifted in accordance with the hour image data 70, which is displayed simultaneously with the minute image data 80.

Further the present embodiment has been described with reference to the case where the numerals from 1 to 12 corresponding to the hours are expressed in English as one, two, . . . , twelve by way of example. Instead, the invention is also applicable to a case where the numerals from 0 to 23 corresponding to the hours are expressed in English as zero, one, two, . . . , twenty three.

Further, in the present embodiment, the minute display table, the hour display position adjustment table, and the hour display table are used to allow the display position of the same hour image data to be changed in accordance with the minute to be displayed. Similarly, a minute display table and a minute display position adjustment table having the same configurations as those of the hour display table and the hour display position adjustment table may be created, and the display position of the same minute image data may be changed in accordance with the hour to be displayed.

As described above, the present embodiment, in which the hour display table contains information that identifies, as a display position of a numeral specified by hour image data or minute image data, a position different from a predetermined standard position even for the same hour or minute in accordance with the hour and minute to be displayed, prevents overlap between fonts and allows legible hour and minute display.

Second Embodiment

A second embodiment of the invention will be described with reference to FIGS. 18 to 21. In the present embodiment, as the hour image data 70, instead of using a plurality of hour image data 70 having different font positions, a plurality of hour image data 70 having fonts themselves different from one another are used.

Figure 20:
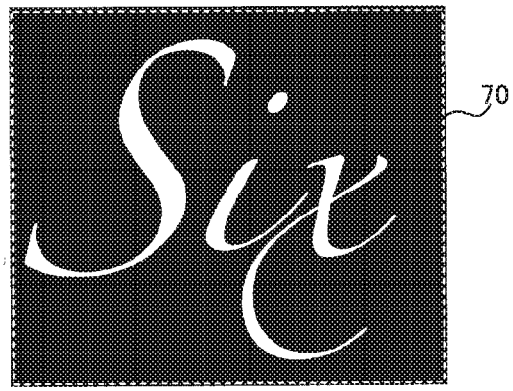
FIG. 20 describes the hour image data using the standard font.

In the present embodiment, hour image data 70 shown in FIG. 20 is set as standard hour image data 70 corresponding to the hour of 6. The standard hour image data 70 corresponding to the hour of 6 uses a font having part of the character "x" of "Six" elongated downward, as shown in FIG. 20. Using the standard hour image data 70 described above undesirably causes, when it is 6:58, for example, the downwardly elongated portion of the character "x" to overlap with the first character "f" of "fifty-eight" representing the minute of 58, resulting in illegible time display.

Figure 21:
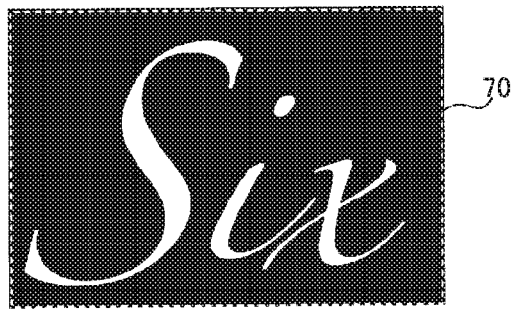
FIG. 21 describes the hour image data using the font different from the standard font.

To avoid the situation described above, in the present embodiment, in addition to the standard hour image data 70 corresponding to the hour of 6, hour image data 70 shown in FIG. 21, which is different from the standard hour image data 70, is prepared, and the hour image data 70 shown FIG. 21, which is different from the standard hour image data 70, is used when characters overlap with each other, for example, in a case where it is 6:58. The hour image data 70 shown in FIG. 21 uses a font having no part of the character "x" of "Six" elongated downward.

Figure 19:
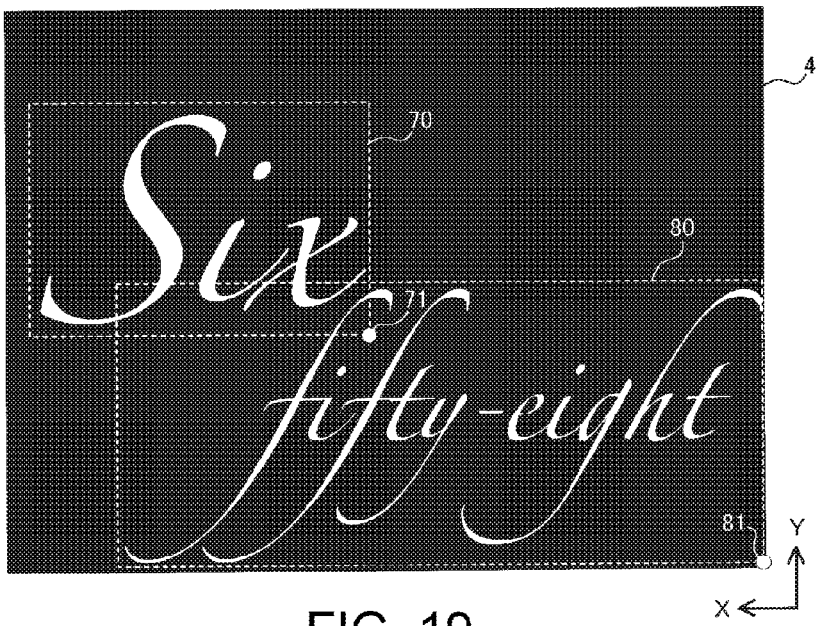
FIG. 19 shows an example of hour image data using a font different from the standard font displayed in the display section.

Using the hour image data 70 described above eliminates the portion where "Six" representing the hour of six and "fifty-eight" representing the minute of 58 overlap with each other and therefore allows legible time display, as shown in FIG. 19.

To achieve the configuration of the present embodiment, for example, "12" is added as the adjustment number to the hour display position adjustment table 92 shown in FIG. 12, the macro name corresponding to the adjustment number of "12" is set to be EMAC_APPEND_A012, and an image name HOUR_B_12.bmp is prepared. HOUR_B_12.bmp corresponds to the hour image data 70 shown in FIG. 21. Further, the macro name corresponding to the adjustment number of "20" is set to be EMAC_APPEND_A020, and the image name is set to be HOUR_B_06.bmp. HOUR_B_06.bmp corresponds to the hour image data 70 shown in FIG. 20.

That is, the hour display table 91 contains information (adjustment number) that identifies, as the hour image data 70, the hour image data 70 (HOUR_B_12.bpm) different from the predetermined standard hour image data 70 (HOUR_B_06.bpm) in accordance with the minute to be displayed even during the same hour, for example, the minute of 29 or 30 during the same hour of 8.

In the hour display table 91 shown in FIG. 11, for example, "20" is written as the adjustment number for the range from 6:00 to 6:39, and "12" is written as the adjustment number for the range from 6:40 to 6:59. The configuration described above allows HOUR_B_12.bmp to be used as the hour image data 70 during the period from the minute of 40 to the minute of 59, the display of each of which starts from the character "f" and eliminates the portion where "Six" representing the hour of 6 and "fifty-eight" representing the minute of 58 overlap with each other, as shown in FIG. 19, allowing legible time display.

The present embodiment has been described with reference to the case where two types of hour image data 70 having different fonts are prepared as the hour image data 70 of "Six" by way of example. Instead, hour image data 70 using three or more types of fonts may be prepared for the display of the same hour. Further, the present embodiment has been described with reference to the hour image data 70 of "Six" corresponding to the display of the hour of 6 by way of example, and a plurality of types of hour image data 70 corresponding to other hours and using different fonts may also be prepared. Further, a plurality of types of minute image data 80 having different fonts may also be prepared, and the minute image data 80 having fonts themselves different from one another may be used in accordance with the time to be displayed.

In the present embodiment, each of the hour image data 70 and the minute image data 80 is image data for drawing characters of a word representing a numeral. Now, let an x direction be the direction in which the characters are arranged, and a y direction be the direction perpendicular to the x direction. The hour image data 70 and the minute image data 80 are so displayed in the display area of the display section 4 that the coordinates thereof (origin 71 of hour image data 70 and origin 81 of minute image data 80) in the y direction differ from each other, as shown in FIG. 19. The configuration described above allows display of image data in a position different from a predetermined position in accordance with the hour and minute to be displayed or display of image data different from predetermined image data in accordance with the hour and minute to be displayed, whereby legible time display is performed irrespective of the font used in the display and diversity in time display is provided.

As described above, the present embodiment, in which the hour display table contains information that identifies, as the hour image data, hour image data different from predetermined standard hour image data in accordance with the hour and minute to be displayed even during the same hour, prevents overlap between fonts and allows legible hour and minute display.

Third Embodiment

A third embodiment of the invention will be described with reference to FIGS. 22 to 24. In the present embodiment, hour image data is divided into tens-place hour image data and ones-place hour image data, and minute image data is also divided into tens-place minute image data and ones-place minute image data. Further, hour image data is formed of images representing numerals corresponding to the hours integrated with images other than the numerals. Minute image data is also formed of images representing numerals corresponding to the minutes integrated with images other than the numerals.

As shown in FIG. 22, in hour image data, first hour image data 70-1, which represents the tens place ranging from 1 to 2, is formed of an image 70*a*, which represents a numeral corresponding to the tens place of the hour, integrated with a non-numeral image 70*b* of a bird house. In FIG. 22, the image 70*a* of the numeral "1" and the image 70*b* of a bird house are drawn as an integrated image. On the other hand, an image 70*a* of the numeral "2" that is not shown but is the other numeral of the tens place is drawn in the form of an image integrated with an image 70*b* relating to a bird other than a bird house.

Similarly, in hour image data, second hour image data 70-2 on the ones place ranging from 0 to 9 is formed of an image 70*c*, which represents a numeral corresponding to the ones place of the hour, integrated with an image 70*d* of bird eggs, which is a non-numeral image. In FIG. 22, the image 70*c* of the numeral "0" and the image 70*d* of bird eggs are drawn as an integrated image. On the other hand, each of images 70*c* of the numerals "1" to "9" that are not shown is drawn as an image integrated with an image 70*d* relating to a bird other than the bird eggs. That is, when the hour advances, the non-numeral image 70*d* combined with the image 70*c* of a numeral representing the ones place of the hour is also changed.

As shown in FIG. 22, in minute image data, first minute image data 80-1, which represents the tens place ranging from 0 to 5, is formed of an image 80*a*, which represents a numeral corresponding to the tens place of the minute, integrated with an image 80*b* of an owl, which is a non-numeral image. In FIG. 22, the image 80*a* of the numeral "0" and the image 80*b* of an owl are drawn as an integrated image. On the other hand, each of images 80*a* of the numerals "1" to "5" that are not shown is drawn as an image integrated with an image of an owl different from the image 80*b* of an owl shown in FIG. 22, an image in which the owl in the image 80*b* is drawn in a different attitude, or any other image. That is, when the minute advances, the non-numeral image 80*b* combined with the image 80*a* of a numeral representing the ones place of the minute is also changed.

Similarly, in the minute image data, minute image data 80-2 on the ones place ranging from 0 to 9 is formed of an image 80*c*, which represents a numeral corresponding to the ones place of the minute, integrated with an image 80*d* of an owl, which is a non-numeral image. The owl drawn as the image 80*d* is an owl of a kind different from the owl drawn as the image 80*b* in the tens place of the minute. In FIG. 22, the image 80*c* of the numeral "0" and the image 80*d* of an owl are drawn as an integrated image. On the other hand, each of images 80*c* of the numerals "1" to "9" that are not shown is drawn as an image integrated with an image of an owl different from the image 80*d* of an owl shown in FIG. 22, an image in which the owl in the image 80*d* is drawn in a different attitude, or any other image. That is, when the minute advances, the non-numeral image 80*d* combined with the image 80*c* of a numeral representing the ones place of the minute is also changed.

In the present embodiment, a partition image data 75, which represents footmarks of an owl, is drawn to partition the entire display into the hour display and the minute display, as shown in FIG. 22.

As described above, in the present embodiment, in which images of numerals for time display are accompanied by non-numeral images, and the non-numeral images combined with the numerals in hour/minute digits are different from one another, diversity in the time display can be provided.

Further, in the present embodiment, the X and Y coordinates of an origin 71-1 of the first hour image data 70-1 are set to differ from those of an origin 71-2 of the second hour image data 70-2. Similarly, the X and Y coordinates of an origin 81-1 of the first minute image data 80-1 are set to differ from those of an origin 81-2 of the second minute image data 80-2. The positions of the coordinates of the origins are not fixed, but the positions of the coordinates of the origin of the image data at each digit change as the image data changes. As described above, in the present embodiment, not only is an image of a numeral for time display combined with a non-numeral image, but also the positions of the coordinates of the origin of each image data is changed, whereby diverse, non-stationary time display can be performed.

In the present embodiment, to perform the display described above, the hour display table 91 and the minute display table 90 are configured as follows: FIG. 23 shows the hour display table 91 according to the present embodiment, and FIG. 24 is the minute display table 90 according to the present embodiment.

As shown in FIG. 23, the hour display table 91 describes an image name, a macro name, and XY coordinates of a tens-place image and an image name, a macro name, and XY coordinates of a ones-place image for each of the hours from 0 to 23. In the present embodiment, the image names, the macro names, and the XY coordinates for the ones place ranging from 0 to 9 differ from one another but are set to be the same for combinations of the same ones-place numeral and different tens-place numerals. For example, at "the hour of 2," "the hour of 12," and "the hour of 22," the ones-place image name is HOUR_C_002L.bmp, the ones-place macro name is EMAC_HOUR_C_A02L, and the ones-place XY coordinates are X020, Y020. Instead, when the ones-place numeral is the same but the tens-place numeral combined therewith is different, the ones-place image names, macro names, and XY coordinates may be different from one another.

Further, in the present embodiment, even when the tens-place numeral and the ones-place numeral are the same, such as "11", the image names, the macro names, and the XY coordinates thereof differ from each other. Instead, when the tens-place numeral and the ones-place numeral are the same, the same image name, macro name, and XY coordinates may be used.

As shown in FIG. 24, the minute display table 90 describes an image name, a macro name, and XY coordinates of a tens-place image and an image name, a macro name, and XY coordinates of a ones-place image for each of the minutes from 00 to 59. In the present embodiment, the image names, the macro names, and the XY coordinates for the tens place ranging from 0 to 5 differ from one another. Further, the image names, the macro names, and the XY coordinates for the ones place ranging from 0 to 9 differ from one another.

The ones-place image names, macro names, and XY coordinates are, however, set to be the same for combinations of the same ones-place numeral and different tens-place numerals combined therewith. For example, at "the minute of 02," "the minute of 12," and "the minute of 22," the ones-place image name is MINUTE_C_002L.bmp, the ones-place macro name is EMAC_MINUTE_C_A02L, and the ones-place XY coordinates are X023, Y023. Instead, when the ones-place numeral is the same but the tens-place numeral combined therewith is different, the ones-place image names, macro names, and XY coordinates may be different from one another.

Further, in the present embodiment, when the tens-place numeral and the ones-place numeral are the same, such as "11", the image names, the macro names, and the XY coordinates thereof differ from each other. Instead, when the tens-place numeral and the ones-place numeral are the same, the same image name, macro name, and XY coordinates may be used.

As described above, according to the present embodiment, the hour display table 91 describes the first hour image data 70-1, which is drawn as a single image formed of an image representing the numerals from 1 to 2 corresponding to the tens place of each hour and a non-numeral image that changes whenever the numeral corresponding to the tens place changes, and the second hour image data 70-2, which is drawn as a single image formed of an image representing the numerals from 0 to 9 corresponding to the ones place of each hour and a non-numeral image that changes whenever the numeral corresponding to the ones place changes.

Further, the minute display table 90 describes the first minute image data 80-1, which is drawn as a single image formed of an image representing the numerals from 0 to 5 corresponding to the tens place of each minute and a non-numeral image that changes whenever the numeral corresponding to the tens place changes, and the second minute image data 80-2, which is drawn as a single image formed of an image representing the numerals from 0 to 9 corresponding to the ones place of each minute and a non-numeral that changes whenever the numeral corresponding to the ones place changes.

The hour display table 91 and the minute display table 90 include combinations of the following information used when predetermined time is displayed: information (image name) that identifies the first hour image data 70-1 and the second hour image data 70-2 as well as the first minute image data 80-1 and the second minute image data 80-2; and information (X coordinate and Y coordinate) that identifies the display position of the first hour image data 70-1 and the second hour image data 70-2 and the display position of the first minute image data 80-1 and the second minute image data 80-2.

Therefore, in the present embodiment, in which images of numerals for time display are accompanied by non-numeral images, and the non-numeral images combined with the numerals in hour/minute digits are different from one another, diversity in the time display can be provided. Further, in the present embodiment, not only is an image of a numeral for time display combined with a non-numeral image, but also the positions of the coordinates of the origin of each image data is changed, whereby diverse, non-stationary time display can be performed.

In the present embodiment, an image relating to a bird is employed as the image of an object other than the numerals representing time. Instead, an image of an animation character, an image of another animal, an image of a plant, an image of a food product, and a variety of other images can be employed. Further, the font of the numerals representing time may be changed as appropriate.

Fourth Embodiment

A fourth embodiment of the invention will be described with reference to FIGS. 25 to 28. In the present embodiment, image data formed only of a font of numerals representing the hours is used as the hour image data, and image data formed of an image that is a combination of a font of numerals representing the minutes and a non-numeral image is used as the minute image data. Further, the non-numeral image is configured to vary and the display position thereof is also configured to vary whenever the minute changes.

Figure 25:
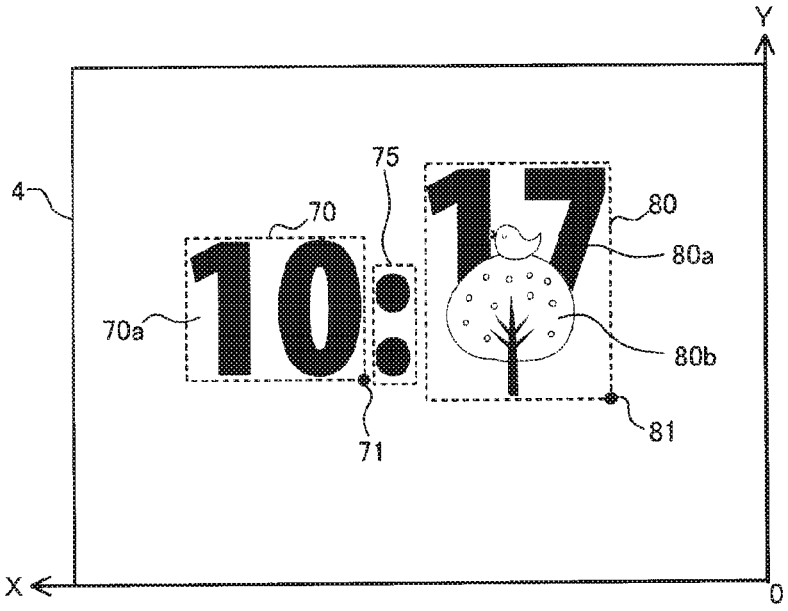
FIG. 25 shows an example of display in the display section according to a fourth embodiment of the invention.
Figure 26:
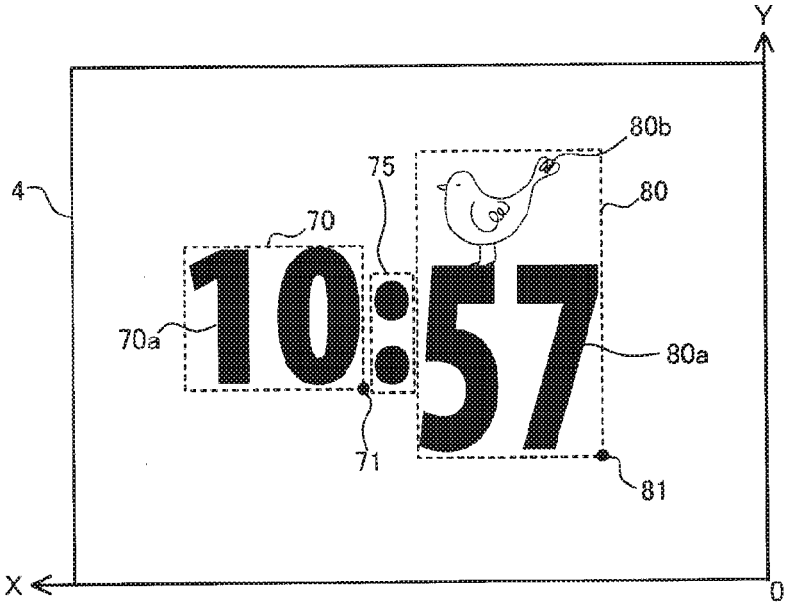
FIG. 26 shows another example of display in the display section according to the fourth embodiment.

The hour image data 70 in the present embodiment is image data having an image 70*a* formed only of a font representing the numerals ranging from 0 to 23 corresponding to the hours, as shown in FIGS. 25 and 26. The minute image data 80 in the present embodiment is image data that is a combination of an image 80*a* formed of a font representing the numerals ranging from 00 to 59 corresponding to the minutes and an image 80*b*, which is a non-numeral image and relates to a bird.

The non-numeral image 80*b* varies whenever the minute changes. For example, the non-numeral image 80*b* is displayed below the image 80*a* of the font representing the numerals ranging from 00 to 59 corresponding to the minutes as shown in FIG. 25 or displayed above the image 80*a* of the font representing the numerals ranging from 00 to 59 corresponding to the minutes as shown in FIG. 26. Further, the image 80*a* of the font representing the numerals ranging from 00 to 59 may also be changed in terms of size whenever the minute changes. Moreover, the coordinates of the origin 81 of the minute image data 80 changes whenever the minute changes.

Although not shown, in the present embodiment, an hour display table 91, which records an image name, a macro name, and XY coordinates corresponding to each of the hours from 0 to 23, may be provided, and the image name, the macro name and XY coordinates may be changed in correspondence with the hour that advances. Further, a minute display table 90, which records an image name, a macro names, and XY coordinates corresponding to each of the minutes from 00 to 59, may be provided, and the image name, the macro name, and the XY coordinates may be changed in correspondence with the minute that advances.

As described above, the present embodiment, which uses, as the minute image data 80, minute image data 80 that is drawn as a single image formed of the image 80*a* representing the numerals corresponding to the minutes and the non-numeral image 80*b* that changes whenever the minute advances, allows diverse time display. Further, the coordinates of the origin 81 of the minute image data 80 can be changed in correspondence with the minutes, whereby diverse, non-stationary time display can be performed.

Figure 27:
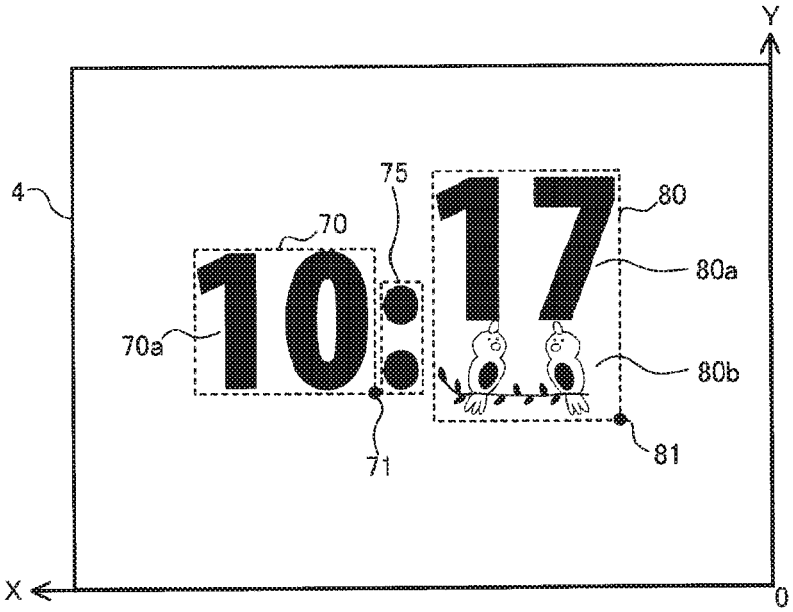
FIG. 27 shows an example of display in the display section according to a fifth embodiment of the invention.
Figure 28:
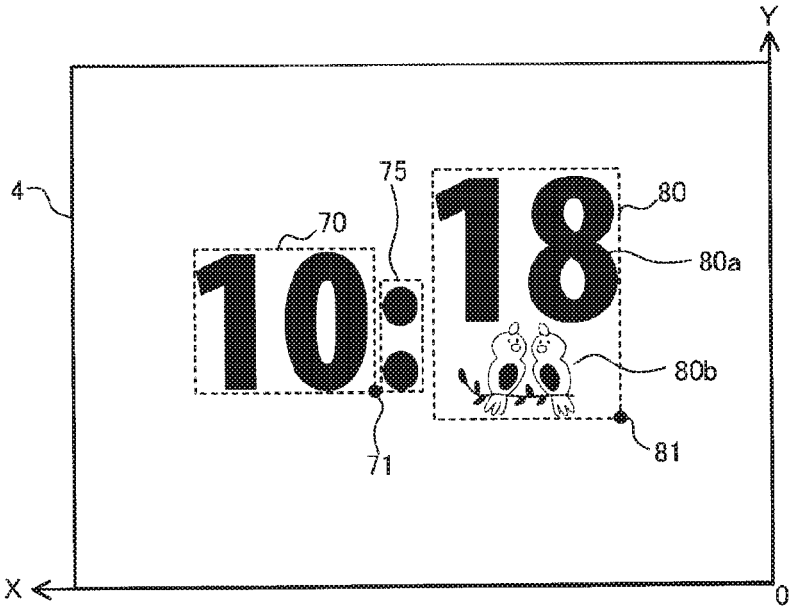
FIG. 28 shows another example of display in the display section according to the fifth embodiment.

In the minute image data 80, in addition to the aspects shown in FIGS. 27 and 28 as an example in which the non-numerical image 80*b* corresponding to each minute is changed as the minute changes, aspects shown in FIGS. 25 and 26 can also be used. In FIG. 27, an image 80*b* of two small birds is drawn below the image 80*a* of a font of the numeral corresponding to the minute of 17, and after one minute or at the minute of 18, as shown in FIG. 28, the image 80*b* of two birds remains in the same position but the two birds are so drawn that they have approached each other. Also in the case where the configuration described above is employed, a diverse, non-stationary time display can be performed.

In the present embodiment, an image relating to a bird is employed as the image of an object other than the numerals representing time. Instead, an image of an animation character, an image of another animal, an image of a plant, an image of a food product, and a variety of other images can be employed. Further, the font of the numerals representing time may be changed as appropriate.

Variations

The invention is not limited to the embodiments described above, and a variety of variations, for example, those that will be described below, are conceivable. Further, one or more arbitrarily selected aspects of the variations that will be described below can be combined with each other as appropriate.

Variation 1

In the first embodiment, the description has been made of the case where the numeral corresponding to each hour is expressed, for example, in English, but the invention is not limited to the aspect and is also applicable to a case where the numerals are expressed in another language. Further, the invention is also applicable to a case where the numeral corresponding to each hour is expressed, for example, by using any of a variety of numerical letters.

In the second to fourth embodiments, the description has been made of the case where the hours are displayed by using 0 to 23, but the invention is not limited to the aspect and the hours may instead be displayed by using 1 to 12 accompanied by AM/PM displayed therewith as shown in the first embodiment.

Variation 2

The hour image data and the minute image data may be rotated before displayed, as in an analog timepiece having an hour hand and a minute hand. For example, hour image data that is a combination of an image representing the numeral corresponding to each hour and an animation character image may be rotationally moved every hour. In this case, the animation character may express daily activities, for example, the animation character wakes up at a certain hour in the morning, takes a lunch at a certain hour in the afternoon, and does a job during daytime. Further, the expression and action of the animation character may be changed whenever the date or day advances.

Moreover, when the minute image data is rotationally moved, animation characters may be so displayed that they chase one another.

Variation 3

In each of the above embodiments and variations, the description has been made with reference to the configuration in which a table is used to select an image and XY coordinates used in the image drawing, but the invention is not limited to the configuration. For example, a function may be used to calculate the trajectories of the coordinates of the origins of the hour image data and/or the minute image data, and the origins of the hour image data and/or the minute image data may be moved along the calculated trajectories.

APPLICATIONS

Figure 29:
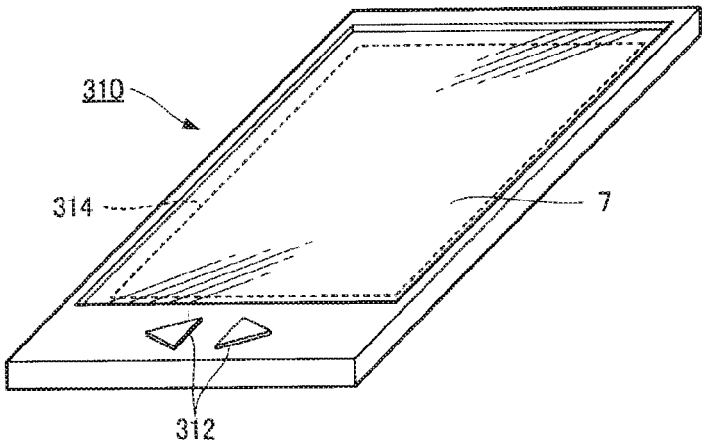
FIG. 29 is a perspective view of an electronic apparatus (information terminal).
Figure 30:
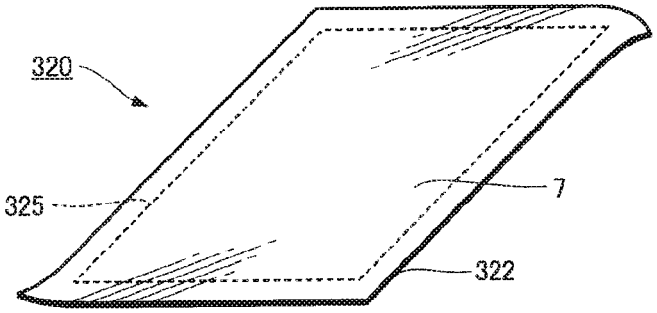
FIG. 30 is a perspective view of an electronic apparatus (electronic paper sheet).

An example of an electronic apparatus to which the invention is applied will be shown below. FIGS. 29 and 30 each show an exterior appearance of an electronic apparatus that employs the electrophoretic display device 7 shown above by way of example.

FIG. 29 is a perspective view of a portable information terminal (electronic book) 310 using the electrophoretic display device 7. The information terminal 310 includes operation elements 312, which are operated by a user, and an electrophoretic display device 7, which displays an image in a display section 314, as shown in FIG. 29. When any of the operation elements 312 is operated, an image displayed in the display section 314 is changed.

FIG. 30 is a perspective view of an electronic paper sheet 320 using the electrophoretic display device 7. The electronic paper sheet 320 includes the electrophoretic display device 7 formed on a surface of a flexible substrate (sheet) 322 as shown in FIG. 30. In the electronic paper sheet 320, an image is displayed in a display section 325.

An electronic apparatus to which the invention is applied is not limited to those described above by way of example. For example, the invention can be employed in a portable phone and timepiece (wristwatch), a portable audio reproduction apparatus, an electronic notebook, a display apparatus on which a touch panel is mounted, a sport apparatus worn around a wrist, a wearable apparatus, and a variety of other electronic apparatus.

Further, the display section according to any of the embodiments of the invention is not necessarily used in an electrophoretic display device and can instead be used in an electrochromic display apparatus having a memory function or a liquid crystal display apparatus.

The entire disclosure of Japanese Patent Application No. 2015-023800, filed Feb. 10, 2015 is expressly incorporated by reference herein.

What is claimed is:

1. An electronic apparatus comprising:

a time measurement section that measures time including an hour and a minute;

an image storage section that stores a plurality of sets of hour image data representing numerals corresponding to hours and a plurality of sets of minute image data representing numerals corresponding to minutes;

a display table representing information that identifies the hour image data and the minute image data used to display a predetermined hour and minute and information that identifies a display position of a numeral specified by at least one of the identified hour image data and minute image data; and a display section that displays, based on the display table, the hour image data and the minute image data representing numerals corresponding to the hour and minute measured by the time measurement section, wherein the display table contains information that identifies, when the hour and minute are a first hour and minute, a first position as the display position of the numeral specified by at least one of the hour image data and the minute image data and information that identifies, when the hour and minute are a second hour and minute that differ from the first hour and minute and have the same hour or minute as the first hour or minute, a second position different from the first position.

2. An electronic apparatus comprising:

a time measurement section that measures time including an hour and a minute;

an image storage section that stores hour image data representing numerals corresponding to hours and minute image data representing numerals corresponding to minutes;

a display table representing a combination of information that identifies the hour image data and the minute image data used to display a predetermined hour and minute and information that identifies display positions of the hour image data and the minute image data; and a display section that displays, based on the display table, the hour image data and the minute image data representing numerals corresponding to the hour and minute measured by the time measurement section, wherein the image storage section stores first or second hour image data as hour image data representing a numeral corresponding to one of the hours, and the display table contains information that identifies the first hour image data as the hour image data when the hour is the one of the hours and the minute is a first minute and information that identifies the second hour image data as the hour image data when the hour is the one of the hours and the minute is a second minute different from the first minute.

3. The electronic apparatus according to claim 1, wherein each of the hour image data and the minute image data is image data that allows characters of a word representing a numeral to be drawn, and under a definition that an x direction is a direction in which the characters are arranged and a y direction is a direction perpendicular to the x direction, the y-direction coordinate of the display position in a display area of the display section differs between the hour image data and the minute image data.

4. The electronic apparatus according to claim 2, wherein each of the hour image data and the minute image data is image data that allows characters of a word representing a numeral to be drawn, and under a definition that an x direction is a direction in which the characters are arranged and a y direction is a direction perpendicular to the x direction, the y-direction coordinate of the display position in a display area of the display section differs between the hour image data and the minute image data.

5. An electronic apparatus comprising:

a time measurement section that measures time including an hour and a minute;

an image storage section that stores a plurality of sets of hour image data representing numerals corresponding to hours and a plurality of sets of minute image data representing numerals corresponding to minutes;

a display table representing information that identifies the hour image data and the minute image data used to display predetermined time and information that identifies display positions of the hour image data and the minute image data; and a display section that displays, based on the display table, the hour image data and the minute image data representing numerals corresponding to the hour and minute measured by the time measurement section, wherein the image storage section stores, as the minute image data, minute image data that allows an image representing a numeral corresponding to the minute and a non-numeral image to be drawn as a single image and further allows the non-numeral image for a first minute and the non-numeral image for a second minute to differ from each other.

6. The electronic apparatus according to claim 5, wherein the image storage section stores, as the hour image data, first hour image data that allows an image representing a numeral corresponding to the tens place of each of the hours and a non-numeral image to be drawn as a single image and further allows the non-numeral image to change when the numeral corresponding to the tens place changes and second hour image data that allows an image representing a numeral corresponding to the ones place of each of the hours and a non-numeral image to be drawn as a single image and further allows the non-numeral image to change when the numeral corresponding to the ones place changes, and further stores, as the minute image data, first minute image data that allows an image representing a numeral corresponding to the tens place of each of the minutes and a non-numeral image to be drawn as a single image and further allows the non-numeral image to change when the numeral corresponding to the tens place changes and second minute image data that allows an image representing a numeral corresponding to the ones place of each of the minutes and a non-numeral image to be drawn as a single image and further allows the non-numeral image to change when the numeral corresponding to the ones place changes, and the display table includes combinations of information that identifies the first hour image data and the second hour image data as well as the first minute image data and the second minute image data used to display predetermined time and information that identifies display positions of the first hour image data and the second hour image data and display positions of the first minute image data and the second minute image data.

7. The electronic apparatus according to claim 5, wherein the image storage section stores, as the minute image data, minute image data that allows an image representing each of numerals from 0 to 59 corresponding to the minutes and a non-numeral image to be drawn as a single image and further allows the non-numeral image to vary.

8. The electronic apparatus according to claim 7, wherein the image storage section stores, as the hour image data, hour image data that allows an image representing each of numerals from 1 to 12 corresponding to the hours to be drawn.

9. The electronic apparatus according to claim 7, wherein the image storage section stores, as the hour image data, hour image data that allows an image representing each of numerals from 0 to 23 corresponding to the hours to be drawn.

10. The electronic apparatus according to claim 6, wherein the image storage section stores, as the first hour image data, first hour image data that allows an image representing each of numerals from 1 to 2 corresponding to the tens place of the hours and a non-numeral image to be drawn as a single image and further allows the non-numeral image to change when the numeral corresponding to the tens place changes, as the second hour image data, second hour image data that allows an image representing each of numerals from 0 to 9 corresponding to the ones place of the hours and a non-numeral image to be drawn as a single image and further allows the non-numeral image to change when the numeral corresponding to the ones place changes, as the first minute image data, first minute image data that allows an image representing each of numerals from 0 to 5 corresponding to the tens place of the minutes and a non-numeral image to be drawn as a single image and further allows the non-numeral image to change when the numeral corresponding to the tens place changes, and as the second minute image data, second minute image data that allows an image representing each of numerals from 0 to 9 corresponding to the ones place of the minutes and a non-numeral image to be drawn as a single image and further allows the non-numeral image to change when the numeral corresponding to the ones place changes.

* * * * *